United States Patent [19]

Burg

[11] Patent Number: 5,020,441

[45] Date of Patent: Jun. 4, 1991

[54] ELECTRIC COUPLING FOR ROTARY GUIDEWAY SWITCH

[75] Inventor: Thomas J. Burg, Forest Hills, Pa.

[73] Assignee: AEG Westinghouse Transportation Systems, Inc., Pittsburgh, Pa.

[21] Appl. No.: 213,206

[22] Filed: Jun. 27, 1988

[51] Int. Cl.[5] ..... E01B 25/06

[52] U.S. Cl. ..... 104/130; 191/29 R; 246/258; 246/415 R; 246/419; 246/431; 246/448

[58] Field of Search ..... 246/257, 258, 415 R, 246/419, 431, 448; 104/101, 130, 247; 191/29 R

[56] References Cited

U.S. PATENT DOCUMENTS

| | | | |
|---|---|---|---|
| 557,338 | 3/1896 | Osborne | 246/431 |
| 557,339 | 3/1896 | Osborne | 246/431 |
| 569,034 | 10/1896 | Sturgis et al. | 246/431 |
| 1,516,513 | 11/1924 | Taffe | 246/431 |
| 1,833,679 | 11/1931 | Jefferson et al. | 246/257 |
| 3,113,529 | 12/1963 | Maestrelli | 246/431 X |
| 3,308,766 | 3/1967 | Urbinati | 246/431 X |
| 3,640,227 | 2/1972 | Webb | 104/130 |
| 3,774,544 | 11/1973 | Mouillon | 104/130 |
| 3,774,544 | 11/1973 | Mouillon | 104/130 |
| 3,782,291 | 1/1974 | Maison | 104/101 X |
| 3,835,785 | 9/1974 | Kirsshner et al. | 104/130 |
| 3,972,293 | 8/1976 | Watts | 104/130 |
| 4,090,452 | 5/1978 | Segar | 104/130 X |
| 4,109,584 | 8/1978 | Mihirogi | 104/130 |
| 4,132,175 | 1/1979 | Miller et al. | 104/130 |
| 4,215,837 | 8/1980 | Vozumi et al. | 246/433 |
| 4,428,552 | 1/1984 | Frank et al. | 246/258 X |
| 4,453,051 | 6/1984 | Brown | 191/29 R X |

FOREIGN PATENT DOCUMENTS

| | | | |
|---|---|---|---|
| 1474851 | 3/1967 | France . | |
| 0589233 | 3/1959 | Italy | 104/130 |
| 0010715 | of 1895 | United Kingdom | 246/448 |

OTHER PUBLICATIONS

"C45 Vehicle System Development Program", APTA Conference, Jun. 5-8, 1988, Westinghouse Transportation Systems and Support Division.

*Primary Examiner*—Andres Kashnikow
*Attorney, Agent, or Firm*—Spencer & Frank

[57] ABSTRACT

A rotary switch for a people mover guideway having a predetermined path, guidebeam and electric rail configuration, routes a transit car having electric power signal collectors from one entry guideway path to either of two exit guideway paths or vice versa. The switch has an elongated structural frame provided with guidelines, electric rail and tire path structure on one side compatible with the guideway configuration to provide car routing to one of the two exit paths. The frame further has guidebeam, electric rail and tire path structure on another side compatible with the guideway configuration to provide car routing to the other of the two exit paths. The electric rail structure on each side of the frame includes power rails and signal rails disposed along the respective switch paths of travel for respectively contacting the electric collectors of the transit car. An electric connection arrangement for the switch includes first electric conductors for connecting the switch power rails to the guideway electric power rail circuit and second electric conductors for connecting the switch signal rails to the guideway signal rail circuit. The first and second conductors are bundled together in a cable which is provided with a nylon cover and which is supported within a bore through one of the shafts about which the switch is rotated. Rotational motion of the frame is thus permitted between the two positions while electric continuity is maintained from the guideway electric power and signal rail circuits, respectively, to the electric power and signal rails on the two sides of the switch frame through direct connection of electric cables.

11 Claims, 23 Drawing Sheets

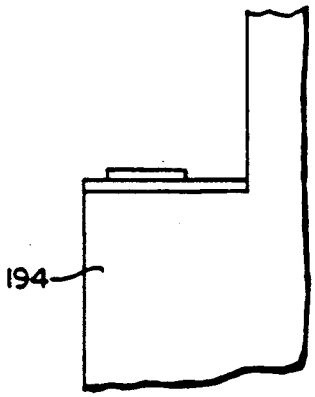
FIG.3M1.
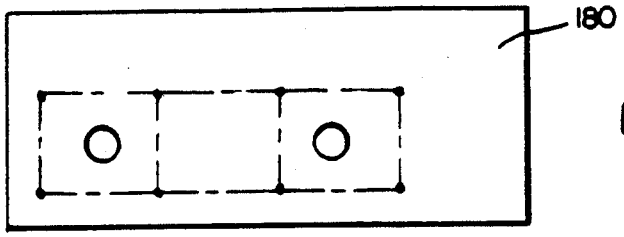
FIG.3N1.
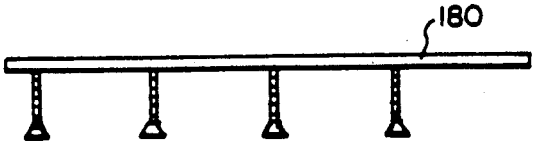
FIG.3N2.
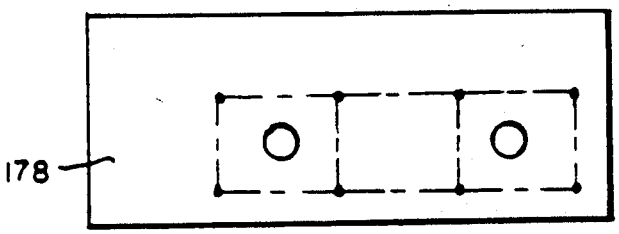
FIG.3P1.
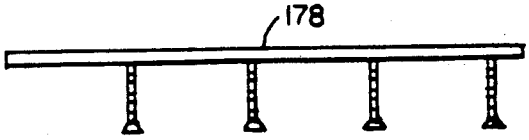
FIG.3P2.

VII AA
VII A
VII B
GND/ATO
AØ
BØ
CØ

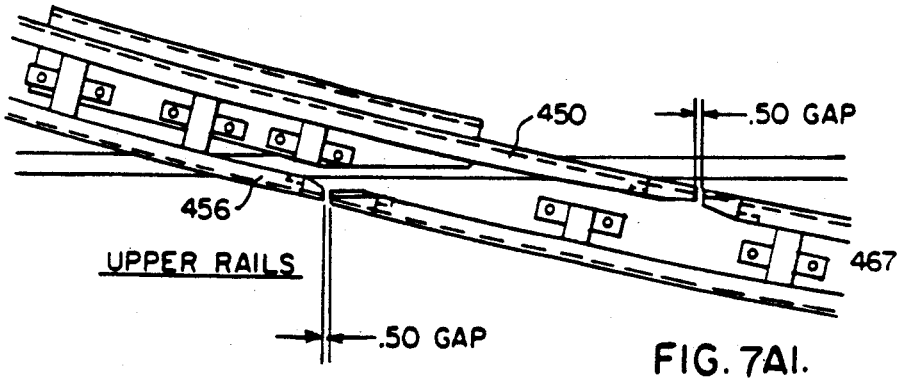
FIG. 7A1.
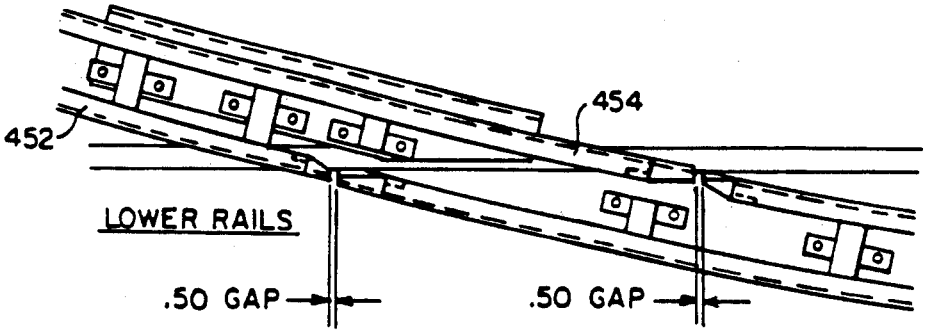
FIG. 7A2.
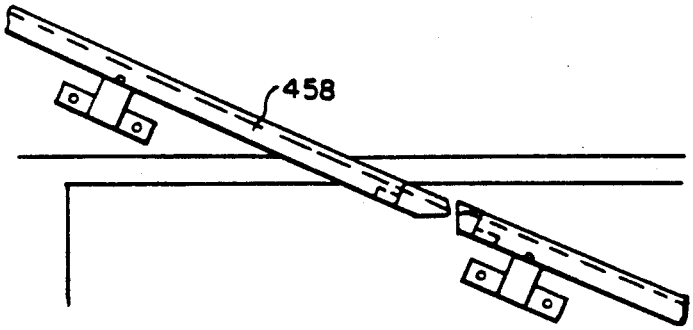
FIG. 7A3.
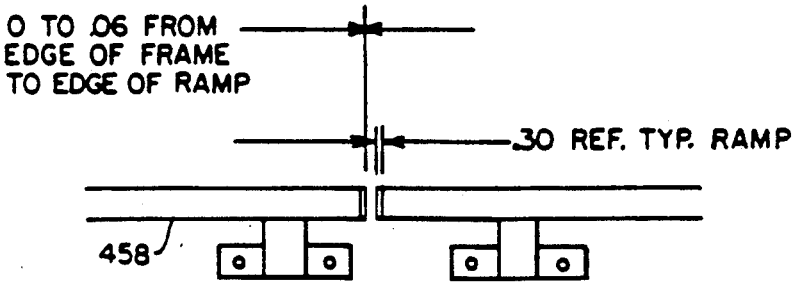
FIG. 7A4.

ELECTRIC COUPLING FOR ROTARY GUIDEWAY SWITCH

CROSS REFERENCE TO RELATED APPLICATIONS

The following related and concurrently filed and coassigned patent applications are hereby incorporated by reference:

U.S. patent application Ser. No. 07/711,723, filed concurrently, entitled ROTARY GUIDEWAY SWITCH FOR PEOPLE MOVER SYSTEMS and filed by Thomas J. Burg, William K. Cooper, Robert J. Anderson, Ronald. H. Ziegler and John W. Kapala.

U.S. patent application Ser. No. 07/211,734, filed concurrently, entitled SAFETY LOCKING STRUCTURE FOR A ROTARY GUIDEWAY SWITCH and filed by Thomas J. Burg, William K. Cooper and Robert J. Anderson.

U.S. patent application Ser. No. 07/211,725, filed concurrently, entitled GUIDEWAY STATION FOR A ROTARY GUIDEWAY SWITCH and filed Thomas J. Burg, Robert J. Anderson and Ronald H. Ziegler.

U.S. patent application Ser. No. 07/211,726, filed concurrently, entitled ROTARY GUIDEWAY SWITCH HAVING SINGLE TIRE PATH LOADING and filed by Thomas J. Burg, William K. Cooper, Robert J. Anderson, Ronald H. Ziegler and John W. Kapala.

U.S. patent application Ser. No. 07/211,735, filed concurrently entitled SELF-ALIGNING ROTARY GUIDEWAY SWITCH and filed by Thomas J. Burg.

U.S. patent application Ser. No. 07/211,610, filed concurrently, entitled SINGLE TURNOUT ROTARY GUIDEWAY SWITCH AND A DUAL LANE CROSSOVER STATION EMPLOYING THE SAME and filed by Thomas J. Burg, William K. Cooper, Robert J. Anderson, Ronald H. Ziegler and John W. Kapala.

U.S. patent application Ser. No. 07/211,736, filed concurrently, entitled DOUBLE TURNOUT ROTARY GUIDEWAY SWITCH and filed by Thomas J. Burg, William K. Cooper, Robert J. Anderson, Ronald H. Ziegler and John W. Kapala.

U.S. patent application Ser. No. 07/211,721, filed concurrently, entitled IMPROVED ELECTRIC, GUIDANCE, AND TIRE PATH CONFIGURATION FOR A PEOPLE MOVER GUIDEWAY and filed by William K. Cooper, Thomas J. Burg, and John W. Kapala.

U.S. patent application Ser. No. 07/211,724, filed concurrently, entitled ROTARY GUIDEWAY SWITCH HAVING GUIDEBEAM AND/OR ELECTRIC RAIL STRUCTURE LOCATED ABOVE AND BETWEEN GUIDEWAY TIRE PATHS, filed by Thomas J. Burg, William K. Cooper, Robert J. Anderson, Ronald H. Eiegler and John W. Kapala.

BACKGROUND OF THE INVENTION

The present invention relates to people mover systems and more particularly to guideway switches for such systems.

In cross referenced basic patent application Ser. No. 07/211,723 (W.E. 53893), a general background description is presented and there is disclosed the structure and operation of a new rotary guideway switch and a new guideway configuration for people mover systems. That disclosure embodies a plurality of basic and improvement inventions and accordingly a family of patent applications, including the present application and those applications listed in the Cross-Reference section, are being filed concurrently in correspondence to the respective inventions.

The present patent application is directed to structure arranged to provide hard-wired electric circuit connections between the fixed guideway and the rotary switch.

SUMMARY OF THE INVENTION

A rotary switch for a people mover guideway having a predetermined tire path, guidebeam and electric rail configuration, routes a transit car having electric power and signal collection means from one entry guideway path to at least either of two exit guideway paths or vice versa. The switch has an elongated structural frame provided with guidebeam, electric rail and tire path structure on one side compatibly with the guideway configuration to provide car routing to one of the two exit paths; the frame further has guidebeam, electric rail and tire path structure on another side compatibly with the guideway configuration to provide car routing to the other of the two exit paths.

First support means includes first fixed frame means supporting first shaft means for one end of the switch frame member. Second support means includes second fixed frame means supporting second shaft means for the other end of the switch frame. Means are provided for driving at least one of the shaft means to rotate the switch frame between first and second rotational positions in which the respective switch sides are respectively aligned with the one and the other exit guideway paths.

The electric rail structure on each side of the frame includes power rail means and signal rail means disposed along the respective switch paths of travel for respectively contacting the electric collection means. Electric connection means for the switch include first electric conductor means for connecting the switch power rail means to the guideway electric power rail circuit and second electric conductor means for connecting the switch signal rail means to the guideway signal rail circuit.

The first and second conductor means are supported to permit rotational motion of the frame between its two positions while maintaining electric continuity with direct electrical cable connection, i.e. hard-wired, from the guideway electric power and signal circuits respectively to the electric power and signal rail means on the two sides of the switch frame.

DESCRIPTION OF THE DRAWINGS

The invention is described below with reference to the accompanying drawings, a brief description of which follows. The Figure numbers of a sectional view are keyed to reference planes denoted by Roman numerals and letters. For example, the sectional view of FIG. 3A is taken through reference plane III A in FIG. 3.

FIGS. 3A through 3M1 show respective views that are taken along the indicated reference planes in FIG. 3 and show various structural features of the switch pit;

FIG. 3N1 and 3P1 are sectional views along the indicated reference planes in FIG. 3B, and FIGS. 3N2 and 3P2 are side views of FIGS. 3N1 and 3P1, respectively.

FIGS. 6-1F to 6-3S, 6AF-6FF, 6-1P to 6-3P and 6A-P-6BP show various views of the frog and point end equipment frames which support the movable switch member and the hydraulic equipment that operates the guideway switch with 6AF-6EF and 6AP-6BP being sectional views through the indicated reference planes in FIGS. 6-1F and 6-1P, respectively;

FIG. 7AA shows a guideway cross section through the indicated reference plane in FIG. 7 highlighting the guide beam and collection rail structure;

FIGS. 7A1 through 7AA show various enlarged views of the encircled regions in FIGS. 7D and 7E showing electrical rail interfaces between fixed and movable switch electrical rail structure.

DESCRIPTION OF THE PREFERRED EMBODIMENT GUIDEWAY SYSTEM

Figure 1:
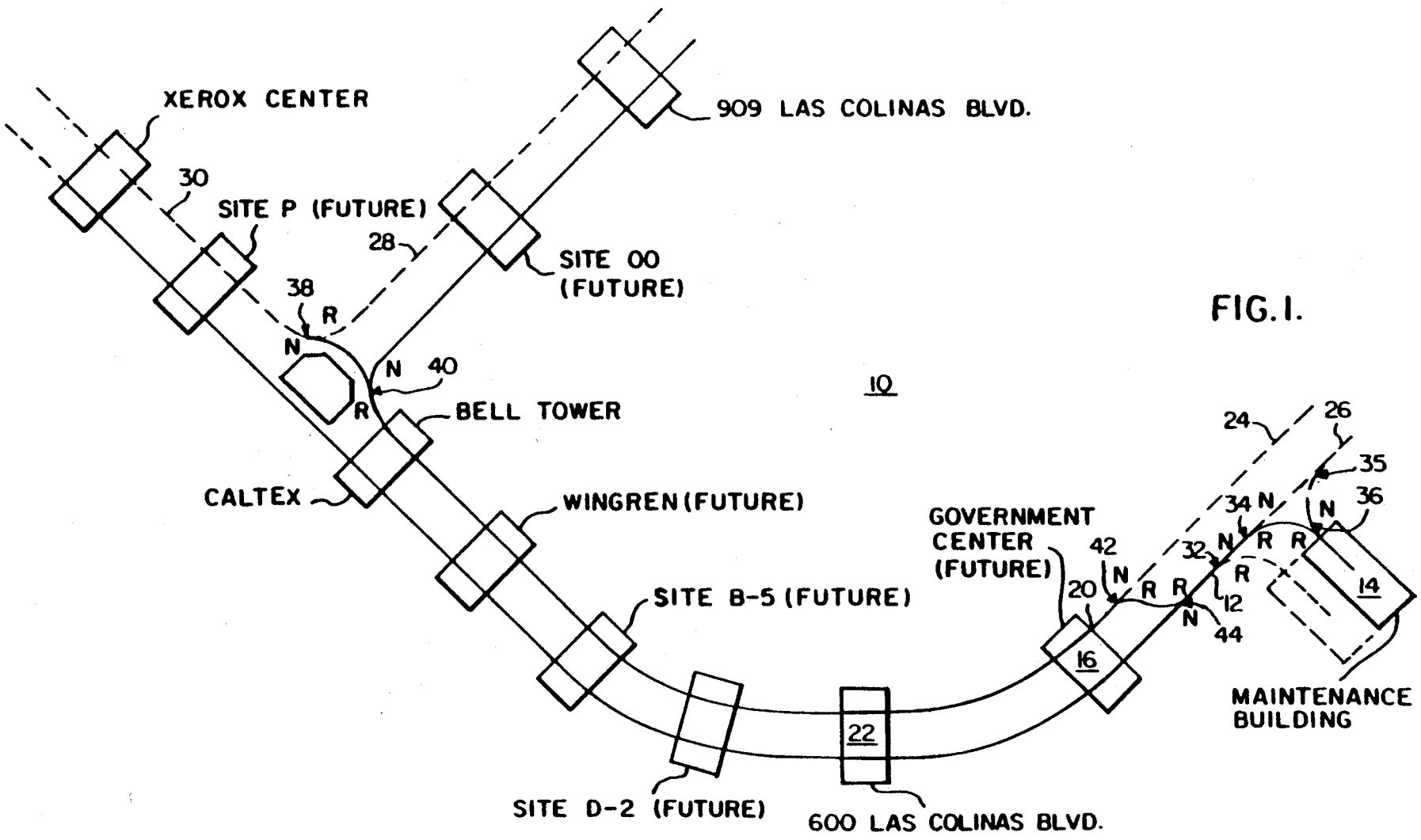
FIG. 1 shows a schematic diagram of a guideway layout for a people mover system having rotary guideway switches made and operated in accordance with the principles of the invention.
Figure 1A:
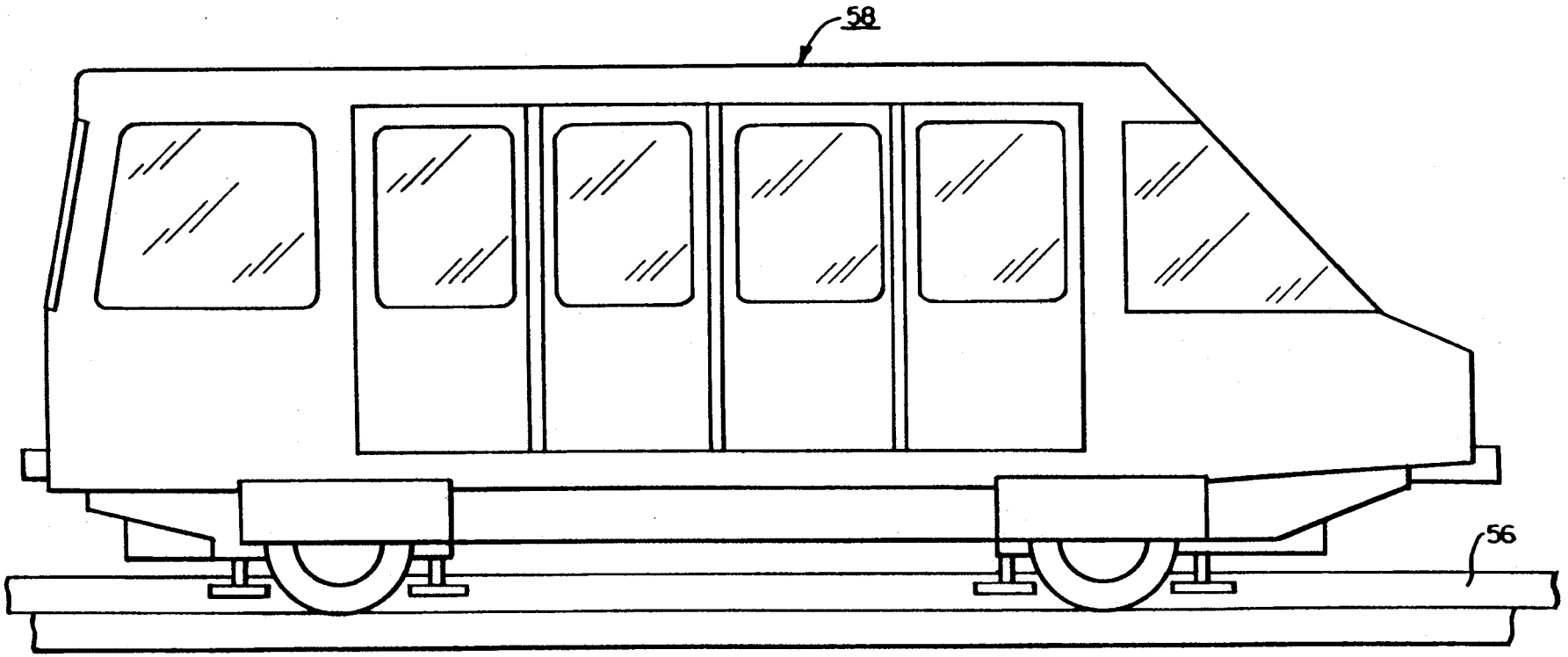
FIG. 1A shows an elevational view of a car of the type employed on the guideway of FIG. 1.

More particularly, there is shown in FIG. 1 a people mover system 10 in which the present guideway switch invention is embodied. The system 10 is a schematic representation of Phase 1 of a people mover system being commercially supplied by the assignee of the present invention to a location in Texas and referred to as the Las Colinas Area Personal Transit System.

The system 10 includes a first guideway lane 12 which extends from a maintenance building 14 to a Government Center Station 16 through various other stations to a Xerox, Center Station which is currently the last station on the guideway lane.

A second guideway lane 20 extends from the station 16 to a Las Colinas Boulevard Station 22. Normally, where guideway lanes are placed beside each other along a common run, it is desirable that the lane spacing be minimized consistent with operating requirements because of construction and land costs. Once the lane spacing is defined, it is highly desirable that any guideway switches needed for lane switching be structured so that they can be located within the available lane space without requiring costly widening of the lane spacing around the switch locations. In the present case, the spacing between lane centerlines is 11 feet.

Dotted guideways 24, 26, 28, and 30 represent planned future guideway additions. Various additional stations are provided for the guideways as indicated by the illustrated blocks with accompanying station names.

In the present system configuration, right hand single turnout guideway switches 32 and 34, as well as a planned future left hand single turnout switch 35, are located near the Maintenance Building. A double turnout guideway switch 36 is also located nearest the Maintenance Building and two double turnout guideway switches 38 and 40 are located near the Caltex station.

Guideway switches 42 and 44 provide a crossover between the lanes 12 and 20 of a dual guideway. The crossover guideway switches 42 and 44 are right hand single turnout switches which provide the lane crossover routing without requiring widening of the specified guideway lane spacing. Use of transfer tables, pivotal switches and other prior art schemes would require lane widening for switch placement.

GUIDEWAY CONFIGURATION

Figure 1B:
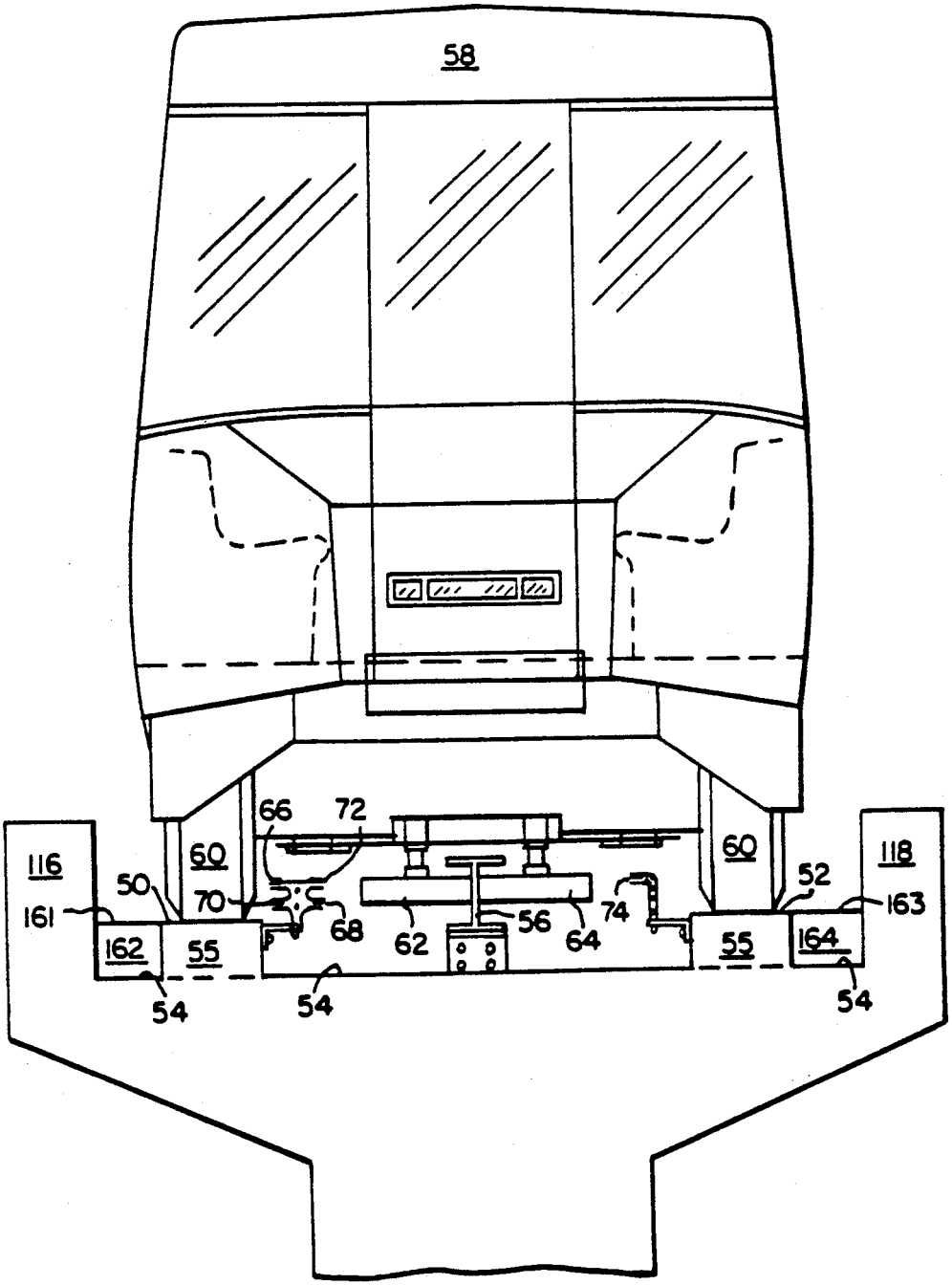
FIG. 1B highlights the guideway configuration at a typical cross section of the guideway with a vehicle on it.
Figure 1C:
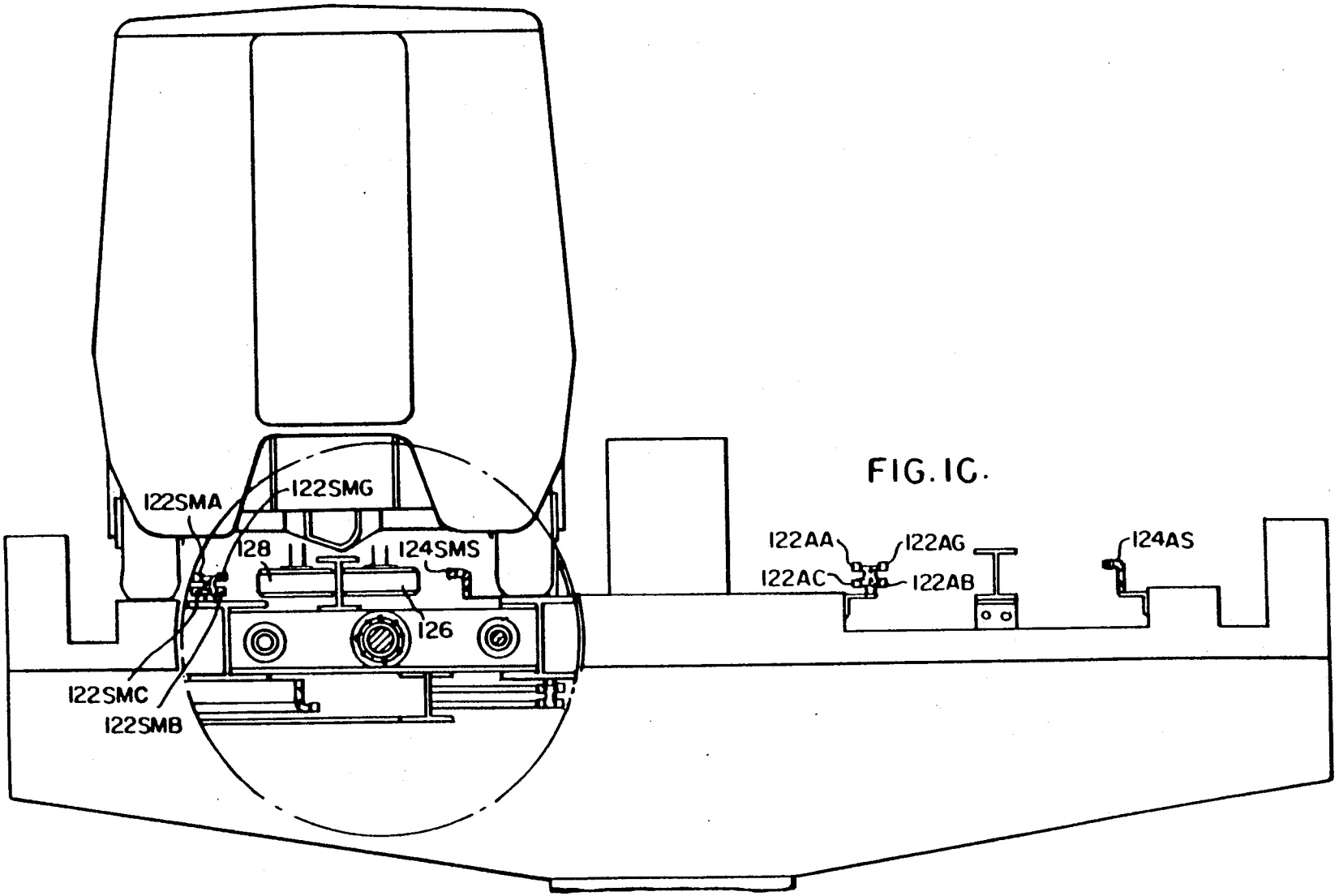
FIG. 1C shows a cross section of a dual lane portion of the guideway at a switch location thereby highlighting the configuration of the rotary guideway switch and its match with the guideway configuration.

The guideway configuration is illustrated in FIG. 1B by means of a cross-sectional view of the elevated guideway with a vehicle on it. FIG. 1C shows the guideway configuration at a guideway switch location. Generally, the guideway can be structured so that the vehicle tire running surfaces are above or below or at ground level. A vehicle 58 is provided with rubber tires 60 that propel the vehicle 58 when running vertically on surfaces 50 and 52.

As shown, the guideway tire running surfaces 50 and 52 can be spaced surface portions running along the length of the surface of an elongated concrete guideway slab 54. In this case, it is preferred that the running surfaces be provided on pads 55 elongated in the longitudinal direction and extending slightly upwardly from the concrete guideway structural slab 54. Cable troughs 162 and 164 are respectively provide outwardly of the tire running pads. Metallic covers 161 and 163 are provided for the troughs 162 and 164. If the vehicle should become disabled and stop at any point along the guideway, the surface of the cover 161 and the tire pad surface 50 together and the surface of the cover 163 and the pad tire surface 152 together form respective sidewalks for passenger use.

A guidebeam 56 is supported by the slab 54 and extends along the slab 54 midway between the running surfaces 50 and 52. The vehicle 58 carries guide wheels 62 and 64 having rubber tires that run horizontally along the guidebeam structure provided by successive guideway slabs to provide lane guidance for the vehicle 58.

Electric rail structure runs along the length of the guideway slab and is supported above and to one side of 1 each of the running surfaces. Generally, the rail structure is configured to provide electric power for vehicle propulsion and electric signals for vehicle control.

Specifically, rails 66, 68 and 70 carry power current for the vehicle 58 and rails 72 and 74 carry central station control signals for directing vehicle operation on the guideway.

In the preferred guideway configuration, the electric, rail and guidebeam structure is located above and between the vehicle tire paths and it is organized to enable continuous current collection through continuous electric railing at guideway switch locations without mechanical on/off rail ramping of the car collector assemblies. By this location definition it is meant that the current collection surfaces on the electric rails and the guidance surface on the guidebeam are located above and between the tire surfaces. Normally most or all of the guidebeam and electric rail structure would thus be above the reference plane through the tire paths, but some portions of this structure may be located below the tire path reference plane so long as the current collection and guidance surfaces are located above this reference plane and between the tire paths. Current collection and guidance hardware on the underside of the vehicle can thus be designed to provide: 1) specified ground clearance for the underside of the vehicle; 2) in conjunction with the rail structure, completely reversible vehicle operation on the guideway; and 3) in conjunction with the rail structure, continuous current collection through guideway switch locations without mechanical on/off rail ramping of the vehicle collector assemblies.

Further, the running surface, electric rail and guidebeam structure is preferably symmetrically disposed on the two sides of the guideway lane centerline thereby enabling turnaround operation of vehicles on the guideway. By turnaround operation, it is meant that either end of the vehicle can be the leading vehicle end for vehicle travel over a guideway lane in either guideway direction with guidance and current collection functions being provided in both directions of vehicle travel. Generally, turnaround operation is enabled by the described symmetric disposition of electric rail and guidebeam structure and cooperative placement of guidewheel and collector assemblies on the underside of the vehicle.

For more information on the background, functions and, advantages of the illustrated guideway configuration, reference is made to the cross-referenced copending patent application Ser. No. 07/211,721.

SINGLE TURNOUT ROTARY GUIDEWAY SWITCH

A single turnout rotary guideway switch 100 (FIGS. 2A–2C) is arranged in accordance with the invention to provide for vehicle turnout from a main guideway lane to a turnout lane.

In one rotary position referred to as the tangent rotary position, the upper side of the guideway switch 100 provides a guideway configuration (guideway, guidebeam, and rail structure) that keeps the vehicle in the lane in which it is moving. When the guideway switch 100 is rotated, preferably through 180 degrees, the previous lower side of the guideway switch 100 becomes the upper switch side and it provides a guideway configuration that directs the vehicle from the lane in which it enters the switch (1) over a turnout path on the switch to a turnout lane or, alternatively, (2) over a crossover path to the other lane of a dual lane guideway. In the latter case, the crossover path leads to another rotary guideway switch 100 located in the other lane and rotatively positioned to direct the vehicle onto the other lane.

Generally, the rotary guideway switch 100 is structured to expose the vehicle as it moves through the switch 100 to a guideway cross-section that is essentially the same as that which exists elsewhere along the guideway. Electrical contact with power and signal rails is continuous as the vehicle moves through the guideway switch 100 in either guideway switch position.

Crossover on a dual lane guideway is achieved without requiring that normal guideway spacing be increased or bulged to permit guideway switch installation. Normally, the spacing of dual guideway lanes is made as small as possible to economize on land and construction costs without sacrificing safety, operational and aesthetic requirements.

Further, self-aligning, failsafe operation of the rotary guideway switch 100 results where the weight of the vehicle load and the switch itself maintain the switch in its existing rotational position. System safety is thereby significantly enhanced.

Preferably, only one of the two guideway tire paths is provided on the tangent side of the switch frame 110. The substantial equivalent of one guideway path (i.e. a portion of each of the two tire paths that together substantially correspond to one path) is preferably provided on the turnout side of the switch frame 110. In this manner, the different guideway configurations required for the two different guideway switch positions can be provided with significant reduction in the switch load bearing requirements and in the switch weight and thus with significant economy and efficiency in switch design and operation.

In end effect, the described "single tire path" structure is a key to providing a minimum weight for a movable section of the guideway while meeting switching requirements. Thus, the same guideway configuration found outside the rotary switch is essentially duplicated by the switch section in both switch positions through rotation of the described rotatable switch element 110 without requiring rotation of the entire guideway cross-section.

The rotary guideway switch 100 is characterized with design flexibility especially since it is readily adaptable to meeting a variety of path switching needs. Among other benefits, its design flexibility additionally facilitates the development of switch designs for different radii of curvature specifications.

Figure 2B:
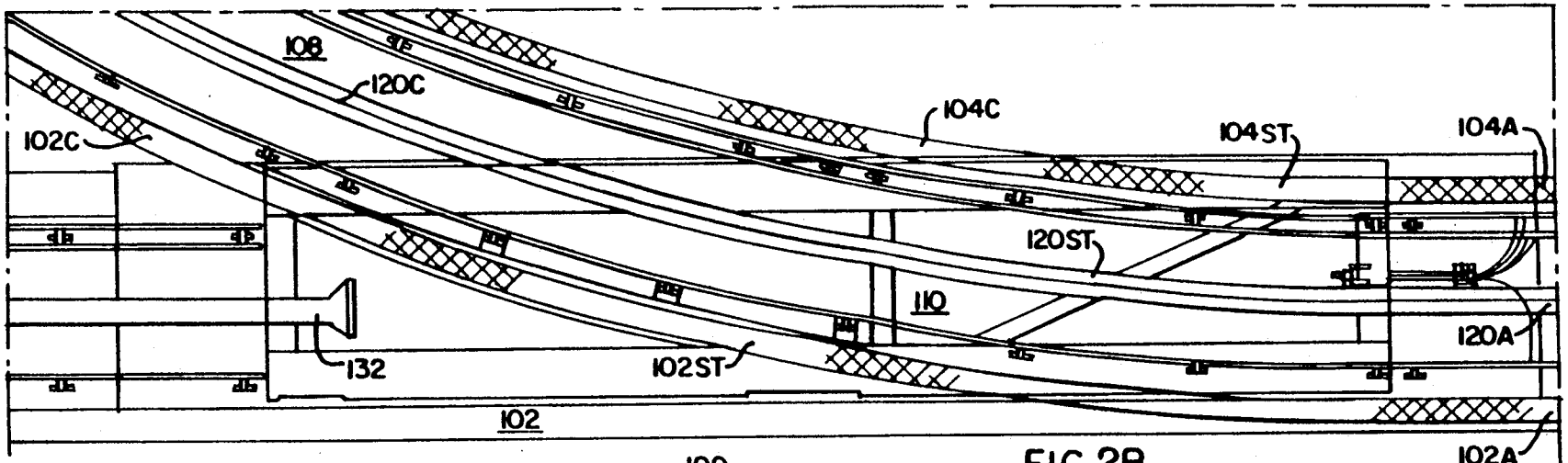
FIG. 2B shows the single turnout switch of FIG. 2A in its turnout position.
Figure 2A:
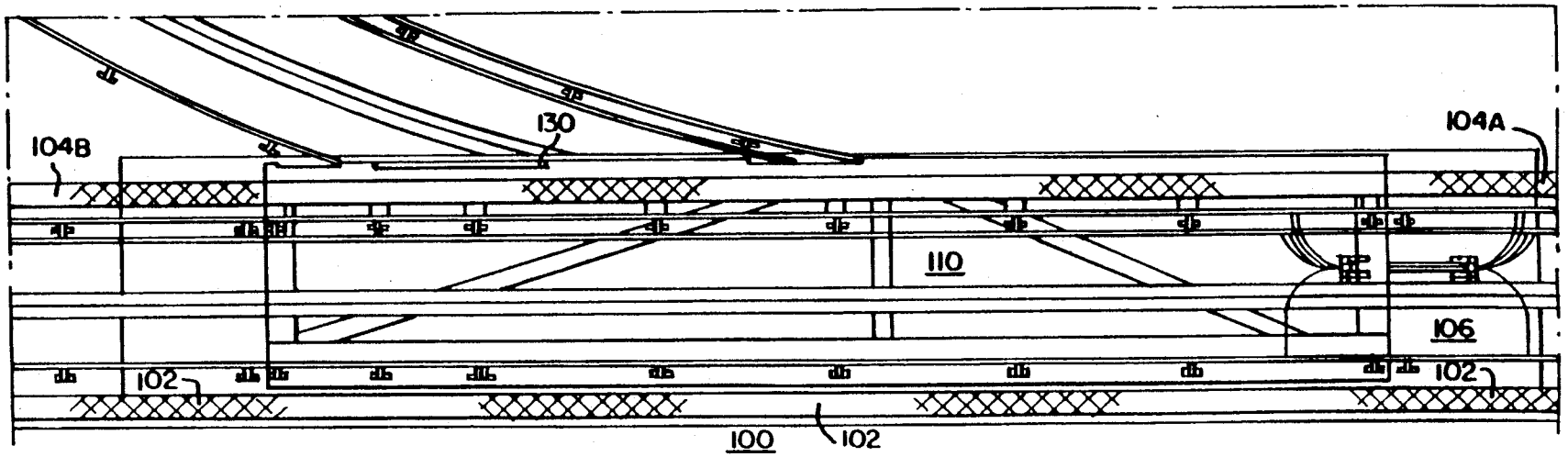
FIG. 2A shows a top plan view of a single turnout rotary guideway switch structured in accordance with the invention and positioned in its tangent or main lane position in a lane crossover implementation of the invention.

There is shown in FIG. 2A a section of a guideway having the single turnout rotary guideway switch 100 in its tangent position. Accordingly, a vehicle is guided over tire running surfaces 102 and 104A, 104B along a main lane 106 as opposed to being switched onto turnout lane 108.

Figure 2C:
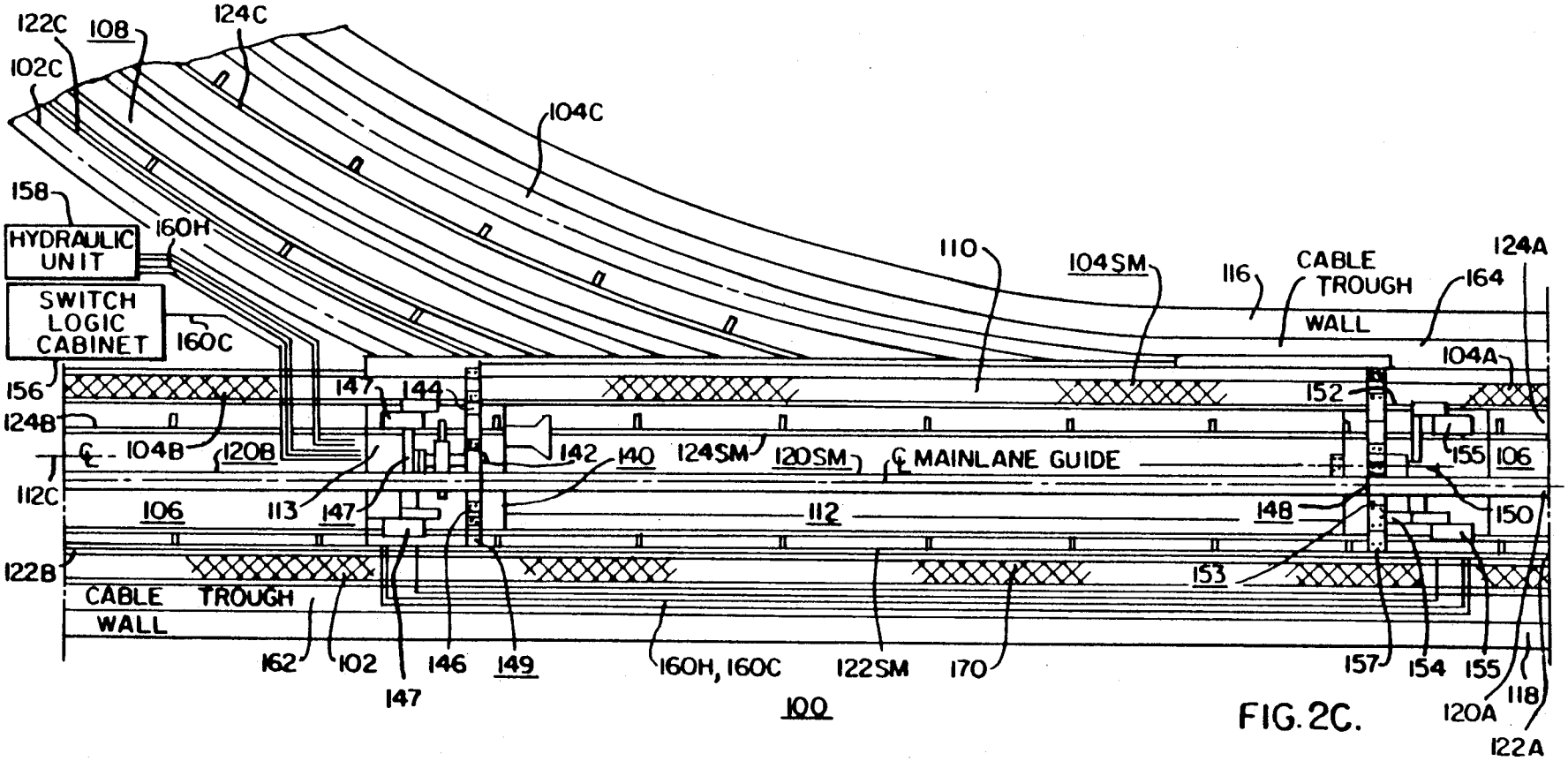
FIG. 2C is a top plan view showing a more detailed top plan view of a general assembly of the single turnout, rotary guideway switch positioned in its main lane position.

The rotary guideway switch 100 comprises a rotatable and in this case generally rectangular frame member 110 that is supported in a switch pit 112 (FIG. 2C) for rotation about longitudinal centerline 112C. Hydraulic and electric operating equipment is also housed in the pit 112 at opposite ends of the frame member 110. Generally, switching is achieved by a hydraulic actuator that rotates the movable frame 110 through 180 degrees about a longitudinal axis from one of its aligned positions to its other aligned position. The switch is secured in either aligned position, preferably by four hydraulically actuated lock pins. More detail is presented subsequently herein on the switch operation (FIG. 2C).

The main guideway has longitudinally extending outer housing walls 116 and 118 within which the tire running surfaces 102 and 104A, 104B, guidebeam 120A, 120B, and power and signal rails 122A, 122B and 124A, 124B are provided. The tire pad with its surface 102 is included as part of the fixed guideway structure.

In the tangent switch position illustrated in FIG. 2A, the upper side of the guideway switch 100 is the tangent side which provides a tire running surface section 104SM (FIG. 2C) that connects main lane tire running surface 104A with main lane tire running surface 104B for continued main lane vehicle operation. A guidebeam section 120SM on the switch movable element 110 connects guidebeam 120A to guidebeam 120B to keep the vehicle on the main lane 106 as it passes through the switch movable element 110. Power and signal rail sections 122A, 122B and 124A, 124B similarly provide main lane interconnections for continuous main lane vehicle electrical contact.

As shown in the cross-sectional view in FIG. 1C, horizontal guide wheels 126 and 128 guide the vehicle over the guideway along the guidebeam 120, in this case the switch guidebeam section 120SM. Electrically conductive brushes on the vehicle provide circuit continuity with the electrical rail sections 122SMA, 122SMB, 122SMC, 122SMG, and 124SMS as the vehicle moves through the guideway switch 100.

In the turnout switch position illustrated in FIG. 2B, the guideway switch 100 is rotated so that the lower or turnout side of the switch element 110 in FIG. 2A becomes the upper side of the switch 100 in FIG. 2B. The turnout side of the switch 100 provides a tire running surface section 102ST and a short section 104ST that respectively connect tire running surface 102A and 104A on the main lane 106 with tire running surface 102C and 104C on the turnout lane 108 for vehicle turnout operation. A guidebeam section 120ST on the switch element 116 connects guidebeam 120A to guidebeam 120C to provide vehicle turnout guidance as the vehicle passes through the guideway switch 100. Power and signal rail sections 122C and 124C similarly provide connections for vehicle turnout operation.

With main lane operation, the tire running surface 102 is on a pad that is part of the fixed guideway structure and the other tire running surface 104 includes the switch tire running surface 104SM. When the guideway switch element 110 is rotated to its other position, the main lane tire running surfaces 102A and 104A are coupled to turnout lane tire running surfaces 102C and 104C by the respective switch tire running surfaces 102ST and 104ST. Significant weight savings and size savings (i.e. radius of rotation) are thus achieved for the rotary guideway switch 100 thereby providing economy of switch manufacture and facilitated switch operation. Significant failsafe switch operation results from the fact that the vehicle weight always acts on the switch tire surface 104SM in the high speed main lane switch position to hold the switch element 110 in position against its safety stops even in the highly unlikely event that all lock pins would be in the unlocked position.

In the lower vehicle speed turnout switch position of this single turnout embodiment of the invention, the vehicle weight similarly acts to provide lock pin backup, over a substantial part of the length of the switch element 110. As will become more evident hereinafter, switch geometry is or can be arranged in various embodiments of the invention to enable complete backup protection through vehicle weight action.

To provide protection against wrongful vehicle entry into a switch that is not aligned with the vehicle switch entry path, i.e. a switch aligned with the other guideway switch entry path, guide wheel stops are provided at the frog end of the switch. In FIG. 2A, stop 130 prevents a vehicle on turnout from entering from the frog end of the switch. In FIG. 2B, stop 132 prevents a vehicle on the main lane from entering from the frog end of the switch.

SINGLE TURNOUT - SWITCH AND EQUIPMENT LOCATION

In FIG. 2C, the single turnout rotary guideway switch 100 is shown with more detail that highlights the location of various structural and equipment items. The switch 100 includes a rotatable frame, a pit for the frame, and other fixed components. The switch pit 112 is an elongated cavity located within the guideway structure to house the generally elongated rotary guideway switch 100 for rotation and to house the equipment and structure needed to drive and support the guideway switch 100. Thus, the pit 112 is roughly subdivided into a main pit (31.5 feet long in this embodiment), a frog end equipment pit (4 feet long) and a point end equipment pit (4 feet long).

The switch rotation occurs about longitudinal centerline 112C. In moving from the tangent position shown in FIG. 2C to the turnout position, the guideway switch 100 rotates in the clockwise direction about the centerline 112C as viewed from the left side of FIG. 2C. As previously considered, the tangent side of the switch 100 provides tire running surface and guidebeam and electrical rail structure appropriate to main lane routing. The turnout side of the switch 100 is appropriately configured for turnout routing.

A fixed or frog end 140 of the guideway switch 100 is supported by a drive shaft 142 and lock pins 144 and 146. Pit space 113 is provided adjacent to the frog end 140 of the switch 100 to house electrohydraulic equipment 147 that drives the frog end switch shaft 142 for switch rotation and operates the frog end lock pins 144 and 146.

A fixed equipment frame 149 supports the drive shaft 142 and the lock pins 144 and 146. The fixed equipment frame 149 additionally includes a rotation safety stop 157A (FIG. 4) that provides backup engagement with a movable switch frame 110 of the switch 100 in its main lane position, i.e. the position shown in FIG. 2C. The inserted lockpins provide the primary definition of the main lane switch position, and the backup stop 157A secondarily defines the main lane switch position in the event the lockpins 144 and 146 are unlocked for some reason. Thus, in the higher speed main lane switch position, vehicle weight is applied over the entire path of vehicle travel against the movable switch frame 110 always to force the switch frame to rotate toward the fixed frame stop 157A. As subsequently considered more fully, the rotary frame weight distribution also causes the switch frame 110 to rotate toward the stop 157A.

A point or expansion end 148 of the guideway switch 100 is supported by a shaft 150 and lock pins 152 and 154. Another fixed equipment frame 153 supports the shaft 150 and the lock pins 152 and 154. The frame 153 also supports electrohydraulic equipment 155 for operating the point end lock pins 152 and 154.

The fixed equipment frame 153 also includes a rotation safety stop 157 (see FIG. 2C) that engages a switch frame portion as a backup for the switch 100 in its turnout position. The stop 157 thus secondarily defines the turnout position of the switch element 110, with the primary turnout position definition provided by the lockpins 152 and 154 when they are inserted into the switch element 110. If all of the switch lock pins are unlocked for some reason in this embodiment, the stop 157 acts as a backup support for the switch frame 110 in its turnout position during the portion of vehicle travel over the switch 100 when the vehicle weight and the switch frame weight urges the switch toward the fixed frame stop 157.

The single turnout switch frame structure can be basically organized like the double turnout switch structure subsequently described herein to adjust the interface between the fixed structure tire path and switch tire path such that the switch tire path geometry enables the vehicle weight to push the switch against its turnout position stop over the entire switch tire path. In that case, continuous and complete backup rotation stop support is also provided in the turnout position of the single turnout switch.

A switch logic cabinet 156 and a hydraulic unit 158 are located outside the guideway structure to provide for guideway switch control and operation. A control conduit 160C and hydraulic lines 160H are routed through the guideway concrete structure for connection to the electrohydraulic equipment 147 and 155. Cable troughs 162 and 164 are provided for routing system signal lines along the entire length of the guideway, and, as shown, the troughs can also be used to route the electrical and hydraulic lines 160C and 160H locally from one end of the pit 112 to the other pit end.

To assure smoothness in the vehicle ride while providing more than adequate space tolerance for switch rotation, the spacing between each end of switch 100 and the adjacent fixed equipment frame 149 or 153 is preferably nominally ½ inch. Moreover, in constructing the guideway system, the equipment frames are secured in place with tolerances that assure placement of the rotary switch 100 such that its upper side configuration in either rotational position is in configuration alignment with the adjacent fixed guideway structure.

FIGS. 3 and 3A–3P2 show various views of the guideway structure with the switch element 110, point end frame 153 and frog end frame 149 removed from the pit 112. The pit geometry and the way in which the switch 100 fits in the pit 112 can thus be better perceived from these Figures. Some noteworthy aspects of the structure will be described. Reference characters used in connection with FIG. 2C have been applied to FIGS. 3–3H, 3J–3N and 3P as appropriate. As indicated, this particular embodiment specifically applies to a right hand turnout switch having a 75 foot radius of curvature. Centerline designations in the various views are as follows: TP means tire path; RF means rotation and foundation; and ML means main lane.

As previously indicated, the tire path 102 on the main lane 106 is formed by fixed wall structure including path portion 102 which runs along one of the longitudinal sides of the pit 112. When the rotary guideway switch 100 is in place in the pit 112 (FIG. 2C), one of the longitudinal sides of the switch 100 is disposed adjacently along the main lane path portion 102.

For a vehicle entry at point end 172 (FIGS. 2C and 3) of the guideway switch 100, fixed main lane path portion 102A is continuous with the fixed tire path portion 170 along the main lane tire path 102. However, fixed main lane tire path portion 104A is interfaced with the rotary switch element 110 by means of a tread plate 178. Similarly, at vehicle exit (frog) end 173 of the guideway switch 100, main lane tire path portions 102 and 102B are continuous. A tread plate 180 interfaces the switch tire running surface on either side of the rotary switch with main lane tire path portion 104B or turnout tire path 102C according to the rotational position of the guideway switch element 110.

Figure 3:
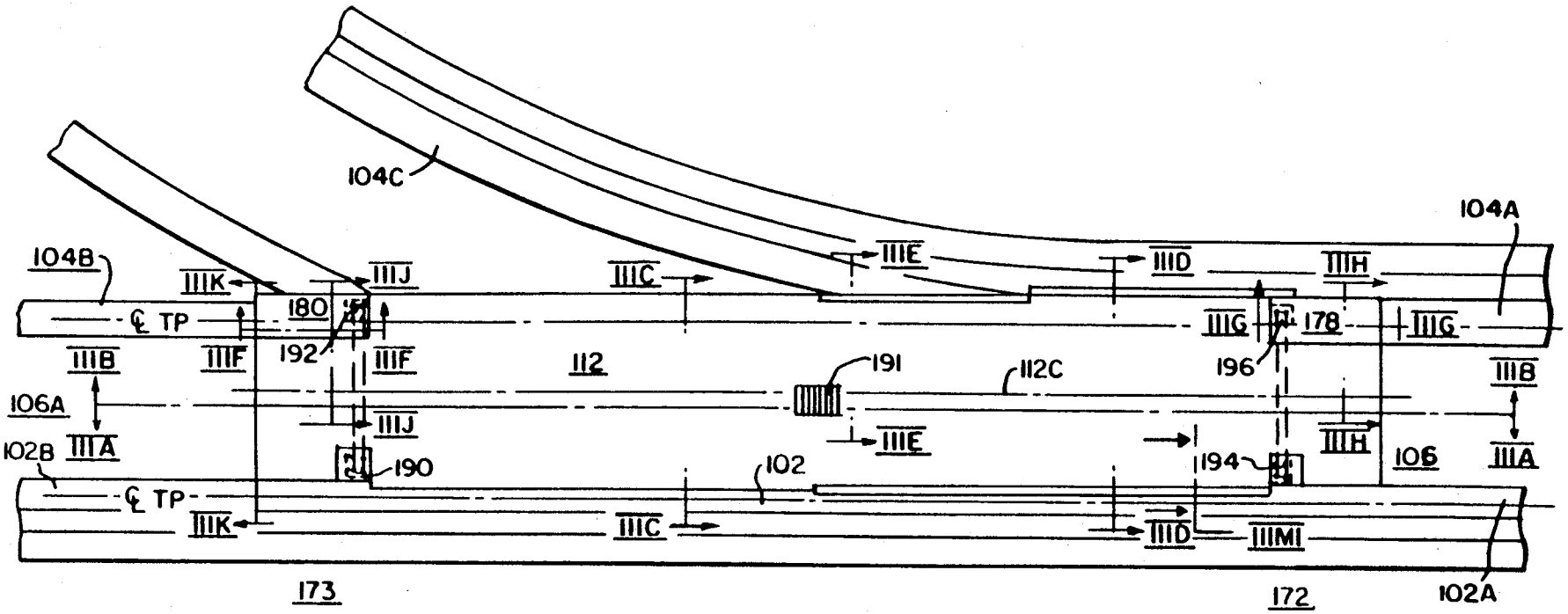
FIG. 3 is similar to FIG. 2C but a part of the guideway switch is taken away to show a pit for the movable switch part and other switch equipment.

The frog end equipment frame is supported by pillasters 190 and 192. As shown in FIG. 3B, the pit is structured also to provide support for the tread plate 180. Similarly, pillasters 194 and 196 provide support for the point end equipment frame and the tread plate 178.

Figure 3A:
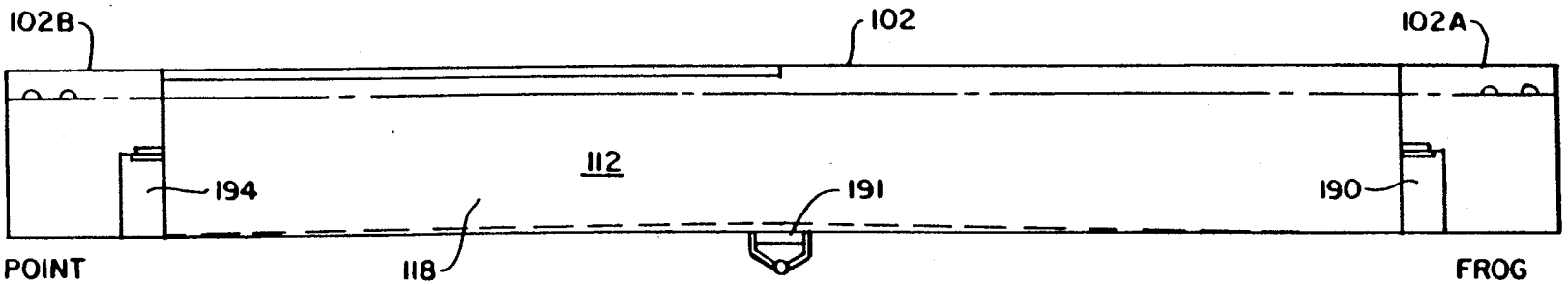
Figure 3B:
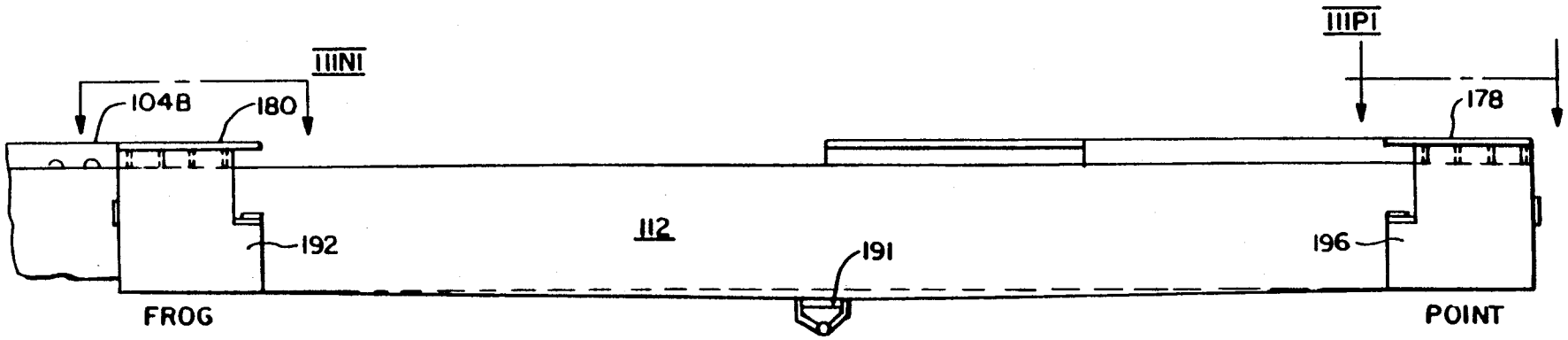
Figure 3C:
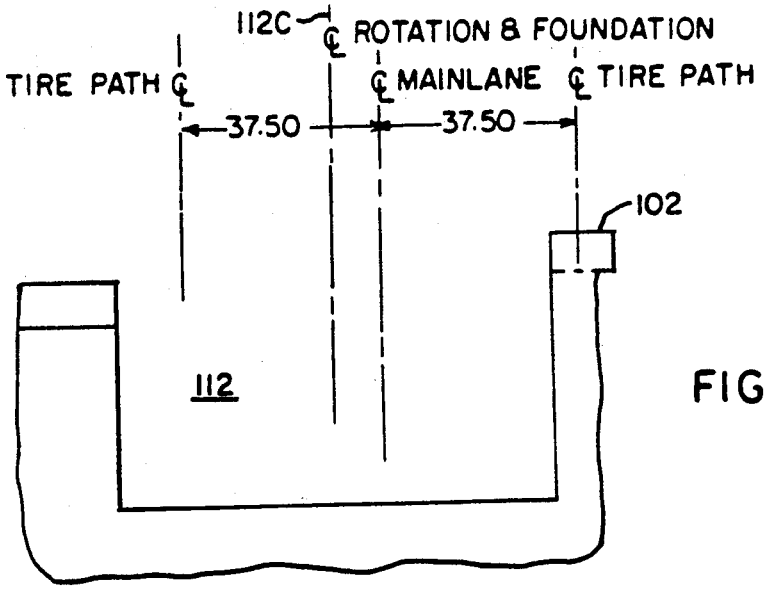
Figure 3D:
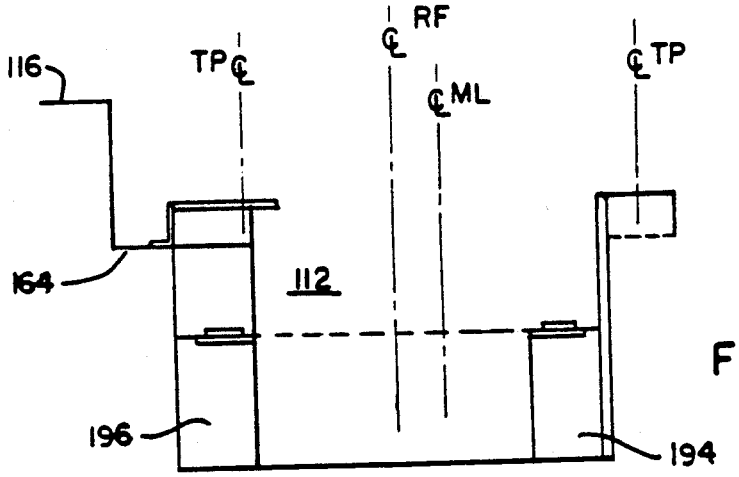
Figure 3E:
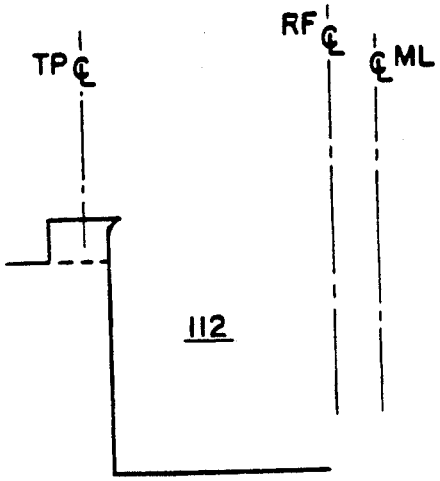
Figure 3F:
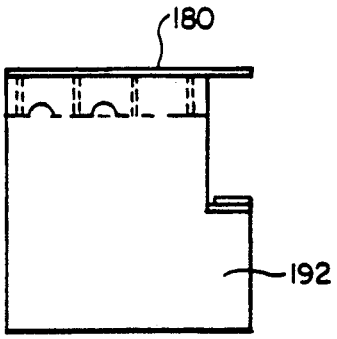
Figure 3J:
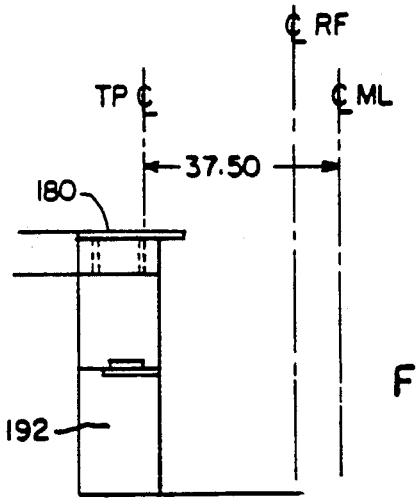
Figure 3G:
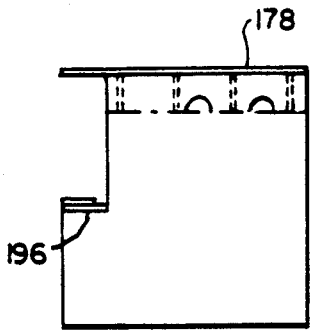
Figure 3K:
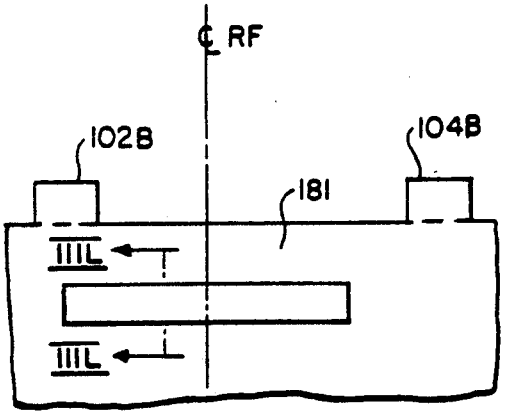
Figure 3H:
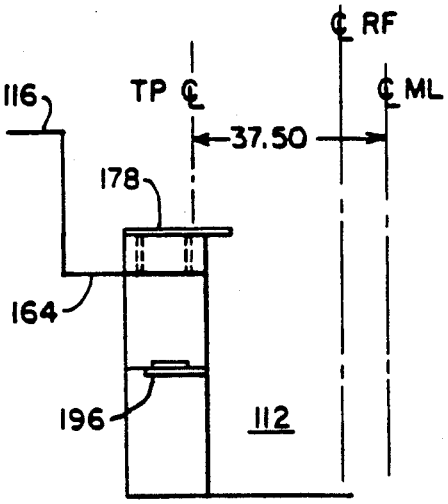
Figure 3L:
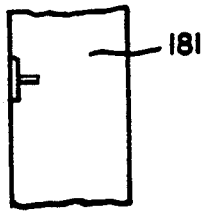

As shown in FIGS. 3A and 3B, the floor of the pit 112 is sloped to provide for drainage through a drain 191. Alternate pit structures, elevated or at grade, may not have floors and would use standard structural steel shapes (e.g. I-beam) for primary members.

The FIG. 3 series of sectional views highlight various structural features of the rotary switch pit 112. FIGS. 3A and 3B show the longitudinal sides of the pit 112 in elevation from the inside of the pit 112. FIGS. 3C-L show various pit elevational cross-sections that highlight the wall and pillaster structure for tread plate and equipment frame support. FIGS. 3M1 and 3M2 are sectional views of the frame 153 secured to the pilaster 194 and accordingly provide additional perspective for this structure. FIGS. 3N1–3P2 are details of plates 178 and 180. These detail views are similar to detail views considered more fully subsequently herein in connection with the crossover switch embodiment of the invention.

SINGLE TURNOUT SWITCH-FRAME STRUCTURE AND SWITCH ASSEMBLY

Figure 4:
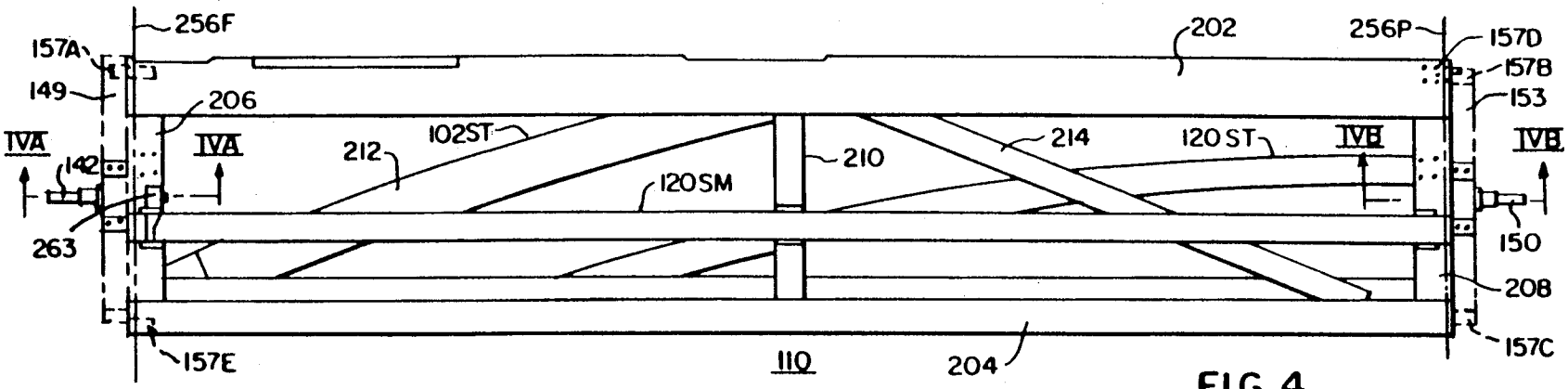
FIG. 4 shows a top plan view of a single turnout rotary frame assembly that includes a portion of the fixed frame supports and a movable part of the guideway switch.

In FIG. 4, the tangent or main lane side of the single turnout rotary guideway switch rotating frame 110 is shown in a plan view. The basic structure of the switch 100 formed by a generally elongated structural frame member 110 comprising parallel longitudinal structural I beams 202 and 204 and frog end, point end and center cross I beams 206, 208 and 210.

From a strength standpoint, the switch framework is arranged to meet all structural and vehicular induced loads within tolerable bending and torsional stresses and specified maximum deflection. From an electrical standpoint, the switch is structured to provide power and signal rail continuity for a vehicle as it enters, passes through and exits the switch.

Generally, the length of the frame 110 is based on the specified radius of curvature for the turnout path at the switching area. A greater radius of curvature requires a greater switch length. In this case, the switch length is approximately thirty-one feet.

The width of the switch frame 110 is preferably less than the overall distance between the tire paths, but the frame width is sufficient to provide the necessary interface width of turnout guideway path on the turnout side of the switch 100 (with the main lane tire path fixed on the side opposite the turnout side). In this way, the rotary switch 100 can be structurally designed with economy for partial car loading as opposed to full car loading. Further, the weight of the rotary switch itself is limited and the rotational diameter of the rotary switch 100 is limited thereby enabling economy in the switch and guideway pit structure and facilitating the operation of the rotary switch 100. In particular, the relatively small size and weight of the switch rotating frame 110 produces efficiency allowing low operational horsepower requirements (less than two horsepower in this application).

The switch frame width in this embodiment is such that the longitudinal beam 202 provides a tire path on the main lane side of the switch 100 for the tires on one side of the vehicle, and the longitudinal beam 204 is placed to lie just inside and below the fixed structure path (see FIG. 3) for the tires on the other side of the vehicle. Thus, only half of the vehicle weight is carried by the rotary switch frame 110 and its support structure in the main lane position.

As in the present case, the rotary switch frame length can be great enough in relation to the vehicle length that a portion of a second vehicle connected to the first vehicle may be located on the rotary switch frame 110 while the entire length of the first vehicle is on the switch frame 110. In that case, the rotary switch frame 110 is designed to support one half of the total vehicle weight that can bear on the main lane side of the rotary switch frame, i.e. the portion of the weight of the full first vehicle translated through the vehicle tires on one side of the vehicle and the portion of the weight of the connected vehicle translated through the single vehicle tire located on the rotary switch frame 110.

On its main lane side, the frame 110 is additionally provided with the main lane guidebeam section 120SM which is secured to the cross beams 206, 208, and 210. The power and signal rail structure is not shown in FIG. 4.

A curved beam 212 provides cross frame support in the diagonal direction between the longitudinal beams 202 and 204 such that it provides the turnout tire running surface 102ST on the turnout side of the rotary switch 100 (the underside of the frame 110 as viewed in FIG. 4). For structural purposes, a bracing I-beam 214 provides similar cross frame support in the opposite diagonal direction, The curved turnout guidebeam section 120ST is also provided on the switch turnout side.

Preferably, fiberglass grating is incorporated into the rotary switch frame to eliminate open areas between structural members and thereby facilitate maintenance and provide a secure stepping surface for passengers who may have to leave a vehicle that has had an emergency stop in the vicinity of a switch. Since the upper and lower sides of the switch frame are used for vehicle routing, the grating is installed to provide for loading on either side of the grating surface. Thus, the grating supports take loading in both directions.

Rotational backup stop action is provided at opposite ends of the switch framework. As indicated by dotted lines in the upper left hand corner of FIG. 4, the safety stop 157A is a stop secured to the frog end fixed equipment frame 149 and is structured and positioned such that its top surface provides stop support, and preferably backup stop support, for the underside of corner portion of top plate of the longitudinal I beam 202 of the frame 110.

Just prior to reaching the main lane stop position, the switch frame 110 is brought to a smooth stop in alignment for insertion of the primary frame supporting lock pins. The described stop structure acts as a backup support in the event lock pins fail to be inserted, i.e. the weight of the switch itself and any vehicle load pushes the switch frame a slight (less than 1/16") additional distance against the backup stop structure.

To enable the switch frame 110 to rotate into the main lane position shown in FIG. 4, the bottom plate of the longitudinal I beam 202 of the frame 110 is notched to remove its corner portion that would otherwise contact the frog end stop 157A and prevent the switch frame 110 from being rotated fully into its main lane position.

As shown in the upper right hand corner of FIG. 4, a safety stop 157D is also preferably provided on the point end of the rotary switch. In this instance, the stop 157D is secured to the rotary frame and it has a projecting finger that engages a stop structure 157B on the point end fixed frame 153 if lockpin support fails in the illustrated main lane position.

In the turnout position of the switch, the bottom surface of the frog end stop 157A similarly provides backup support for the inner surface (upwardly facing in the switch turnout position) of the abutting corner portion of the bottom (in turnout position) flange of the I beam 204. The opposite (top) flange of the I beam 204 is notched as indicated by 157E so that it can pass the stop 157A as the switch frame rotates into its turnout position. The point end stop structure 157C on the point end fixed frame 153 likewise provides backup support in the turnout position for frame stop structure 157D.

Figure 4B:
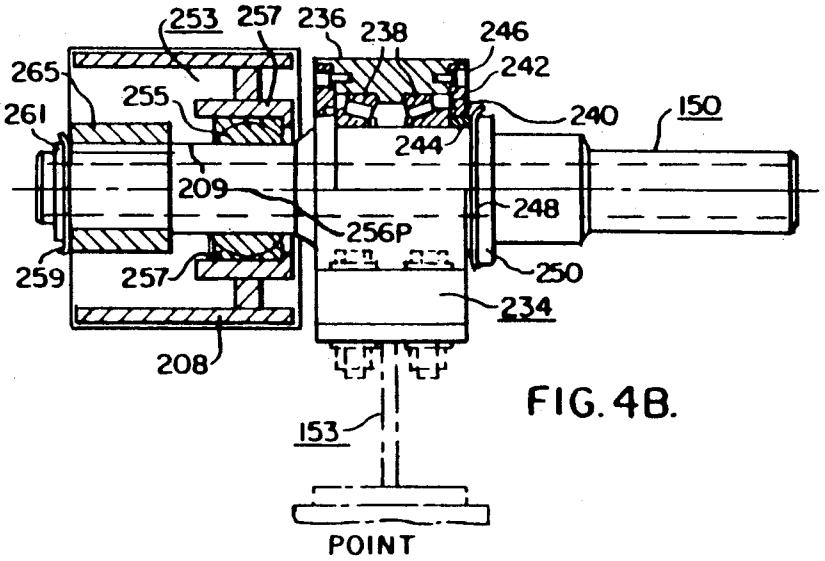
FIGS. 4A and 4B are views taken along the indicated reference planes in FIG. 4 to show the manner in which longitudinal rotary frame expansion is enabled by rolling or floating end beam support provided for the rotary frame by a point end shaft and with vertical support provided at both ends of the frame.
Figure 4A:
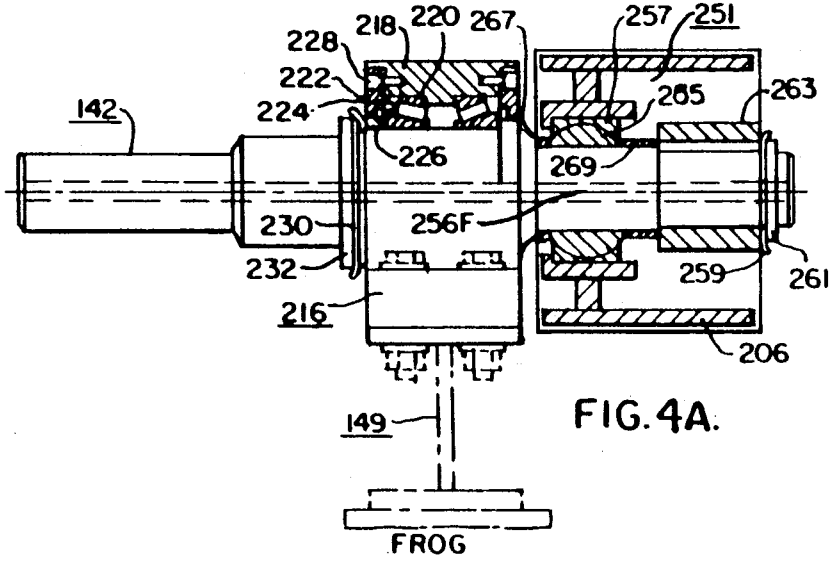

Support structures for the frog end drive shaft and the point end shaft 150 are shown respectively in FIGS. 4A and 4B.

As shown, the drive shaft 142 is supported relative to the fixed equipment frame 149 by means of a fixed tapered roller bearing assembly 216 on which the switch frame is rotated. The tapered roller bearing assembly, is a long-life, anti-friction unit that provides smooth operation and includes the following elements:

218 pillow block and grease fitting
220 bearing cone and bearing cup
222 bearing seal
224 seal retainer and gasket
226 bearing sleeve
228 screw
230 lock washer
232 locknut The point end shaft 150 is supported relative to the fixed equipment frame 153 by means of another fixed tapered roller bearing assembly 234 on which the switch frame is rotated. As above, the tapered roller bearing assembly 234 includes the following elements:

236 pillow block and grease fitting
238 bearing cone and bearing cup
240 bearing seal
242 seal retainer and gasket
244 bearing sleeve
246 screw
248 lock washer
250 locknut The two switch frame shafts 142 and 150 are respectively supported relative to the switch frame cross beams 206 and 208 by similar spherical bearing assemblies 251 and 253 which accordingly provide structural bearing for the switch frame. Each of the spherical bearing assemblies 251 and 253 includes the following elements:

255 spherical bearing supported on shaft
257 bearing seat
259 lock washer
261 locknut A crankarm 263 is provided with the bearing assembly 251 and another crankarm 265 is provided with the bearing assembly 253. Each crank arm 263 or 265 is secured to its shaft 142 or 150 and extends radially outwardly to a point where it has an end portion coupled to the switch frame cross beam 206 or 208. Accordingly, when the crank arm 263 (see the FIG. 4) is driven by the shaft 142, it provides rotational drive force for the switch frame 110. The crank arm 265 similarly connects the passive point end shaft 150 and frame end beam 208 for coupled movement. While the point end crank arm 265 transmits no drive force to the switch frame because the point end shaft 150 is free to rotate, it does tie the frame movement to the movement of the point end shaft 150 so that point end shaft position can be used to confirm the frame point end position with the frame frog end position with use of a position detection device.

The frog end bearing assembly 251 includes spacers 267 and 269 which fix the bearing 257 and the shaft 142 against relative movement in the axial direction. Thus, the frog end of the switch frame is fixed against movement in the longitudinal direction which could otherwise occur as a result of thermal expansion and contraction of the switch frame 110 or as a result of frame bending under vehicle load or vehicle braking or acceleration forces.

At the point end of the frame 110, spacers like the spacers 267 and 269 are omitted thereby enabling the frame point end to undergo longitudinal movement under thermal or vehicle load. In the illustrated embodiment, space is provided for about ⅜ inch outward (rightward) or longitudinal frame movement due to thermal expansion whereas the expected maximum outward movement is ¼ inch. As indicated by reference character 209, space is provided for about 1 inch inward (leftward) longitudinal frame movement due frame bending under vehicle load or due to thermal contraction or installation tolerances.

Figure 4D:
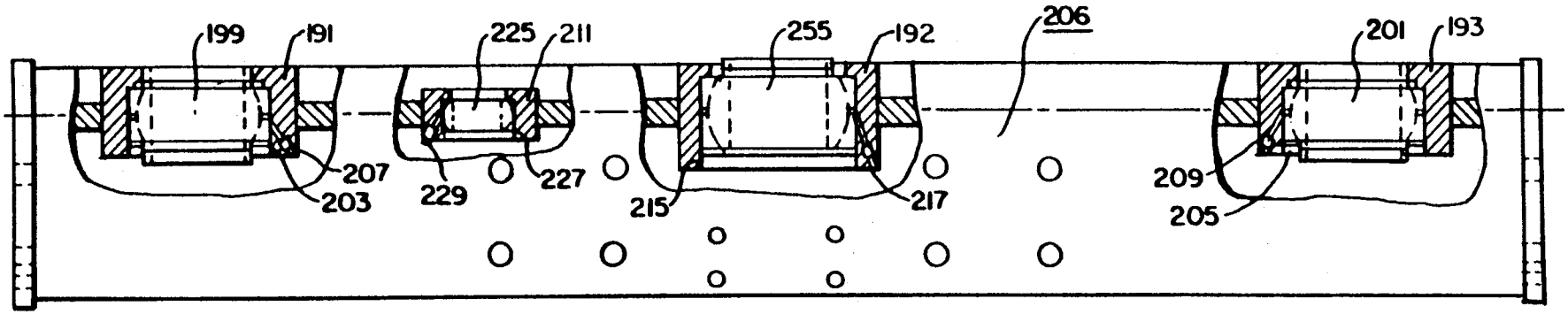
FIGS. 4C and 4D respectively are elevation and broken away top plan views of one of the frame end beams which receive lockpin and shaft support for the switch frame.
Figure 4C:
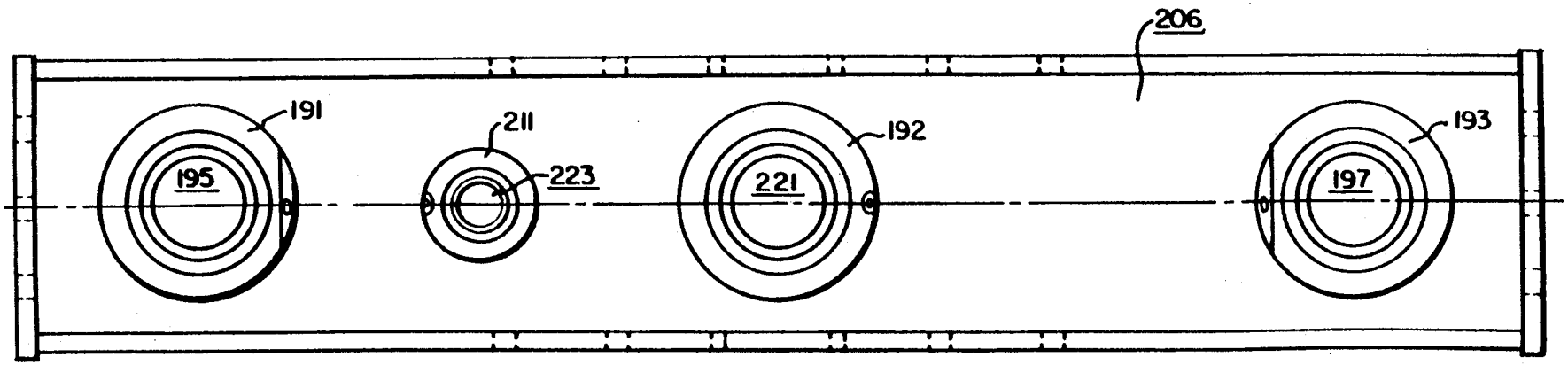

FIGS. 4C and 4D show enlarged views of the frog end cross beam 206 for the guideway switch frame 110. The point end cross beam 208 is the same as the beam 206.

As shown in the elevational view of FIG. 4C, the end beam 206 has respective seats 191 and 193 having openings 195 and 197 for receiving lock pins when the rotary switch frame 110 is rotated into either of its two guideway operation positions. As shown in the plan view having portions broken away (FIG. 4D), lock pin support is provided by a spherical bearing 199 or 201 which is provided with a retaining ring 203 or 205 and a grease fitting 207 or 209.

At a central location of the rotary frame end beam 206, the bearing seat is provided with an opening 221 for receiving the frog end drive shaft 142. The spherical bearing 255 provides shaft support. A retaining ring 215 and a grease fitting 217 are again provided for the bearing 255.

To provide for switch frame rotation, the end beam 206 additionally has a seat 211 with an opening 223 for receiving the radially outward end of the crankarm 263 which is connected to the frog end drive shaft 142. A spherical bearing 225 supports the crankarm 263. Again, a retaining ring 227 and a grease fitting 229 are provided for the bearing 225.

The preferred shaft support arrangement for the switch frame 110 is a type of load support structure referred to as a Simple Supported Beam. This type of support is schematically shown in FIGS. 4E and 4F.

Figure 4E:
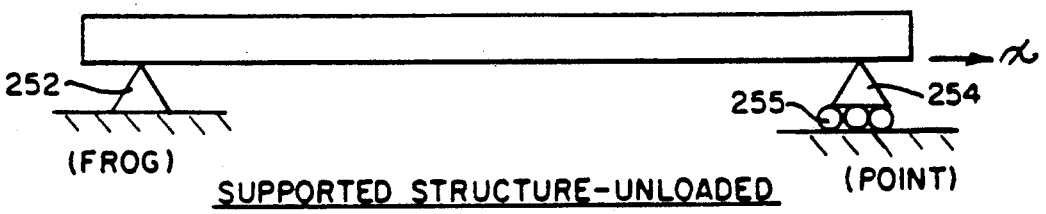
FIGS. 4E and 4F show schematic load diagrams illustrating the operation of the load support arrangement for the switch frame.

In the unloaded condition shown in FIG. 4E, the switch frame 110 extends between its fixed support (frog) end 252 and its longitudinally expandable support (point) end 254. Rollers 255 are used to designate the expandability of the point end support.

Figure 4F:
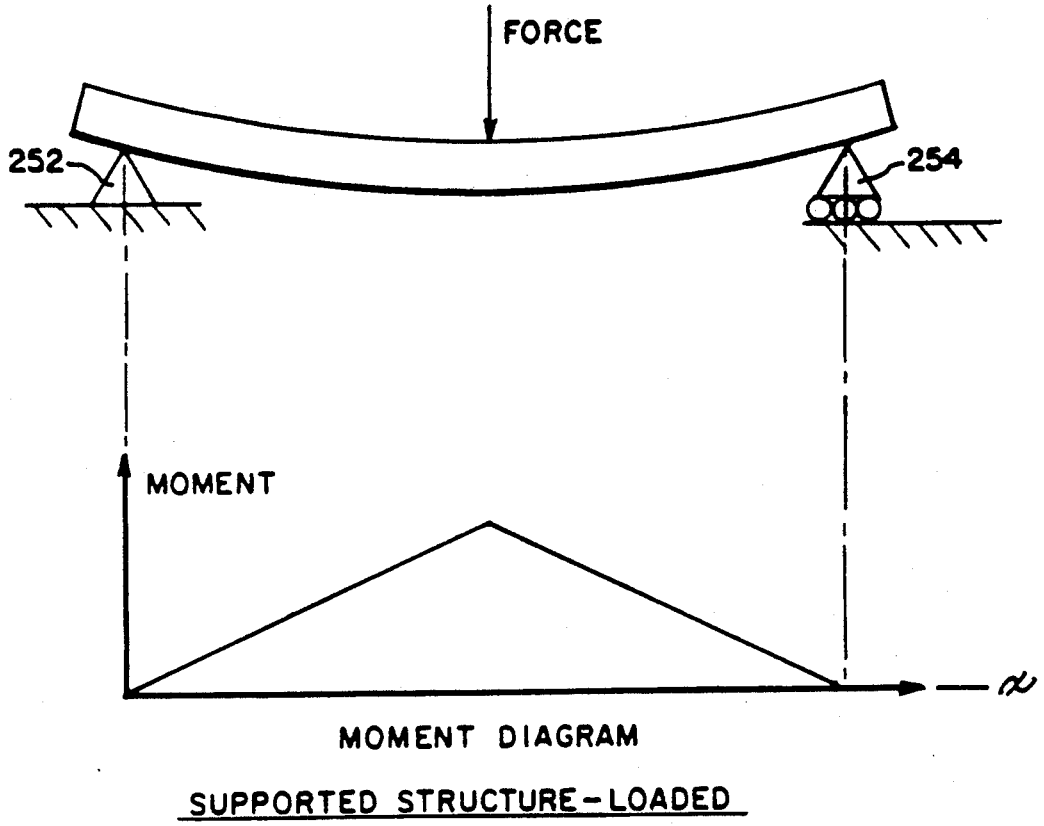

In the loaded condition shown in FIG. 4F, the expansion end support 254 has moved slightly to the left to follow the leftward movement of the point end of the frame caused by downward frame deflection under the load "F". As a result, both ends of the switch frame 116 may rotate freely allowing downward frame bending about a transverse hinge line located at each end support where it passes through, the centerline of the frame end beam supporting spherical bearings (see FIGS. 4A, 4B, 4C and 4D).

In other words, the lockpins and rotating shaft are mounted on spherical seats located on a common reference line thereby freeing the framework to rotate about the center line as a hinge line under induced vehicle load. With hinge line rotation, translational forces to the hinge line are always vertical, and moments are distributed along the switch framework while essentially no bending moments are induced on the lockpins and shafts, i.e. the latter are significantly reduced in size compared to fixed end support (such as straight bore as opposed to spherical bearing receptacle). In effect, the switch frame carries vehicle load and transfers minimal bending moments to the supporting shafts and lockpins without frame leveraging that would otherwise cause high stresses on the shafts and lockpins.

The hinge line is designated by the reference character 256F in FIG. 4 at the frog end and is best observed in FIG. 4A. A similar hinge line 256P operates at the point end of the frame, and it is best observed in FIG. 4B.

As a result of the operation of the preferred simple support structure for the switch frame support arrangement, vehicle load forces are transmitted through the frame hinge lines essentially as shear stress on the shafts and the lock pins. Otherwise, bending loads applied over the length of the switch frame would produce high tensile stresses on the shafts and locking pins thereby requiring excessively or impractically sized structures for these supporting elements.

It is also significant that the described spherical bearing support structure provides a self-aligning feature permitting 180° rotation of this switch frame 110 without binding against the shafts due to thermal distortion or due to manufacture to accuracy limitations. This self-alignment occurs since the spherical bearings can rotate, relative to the switch frame.

Preferably, the lock pin spherical bearings have extended rings that limit the extent of bearing rotation relative to the switch frame thereby assuring alignment conditions for lock pin insertion, to line up with centerlines of the frame support shafts. The lock pin spherical bearings similarly provide self-alignment since the bearings can rotate relative to the switch frame to permit lock pin alignment with the bearings when the switch is rotated into position for lock pin insertion.

In a particular commercial embodiment, the framework was formed from A36 steel employing both rolled and fabricated structural sections. The framework had a span of 31 feet 3 inches, a depth of 17 inches and a width of 6 feet 7 and ¼ inches. To minimize the cumulative effects of fatigue, all connections except one were secured by high strength bolts. Maximum live load deflection at midspan was ¼ inch.

Figure 5:
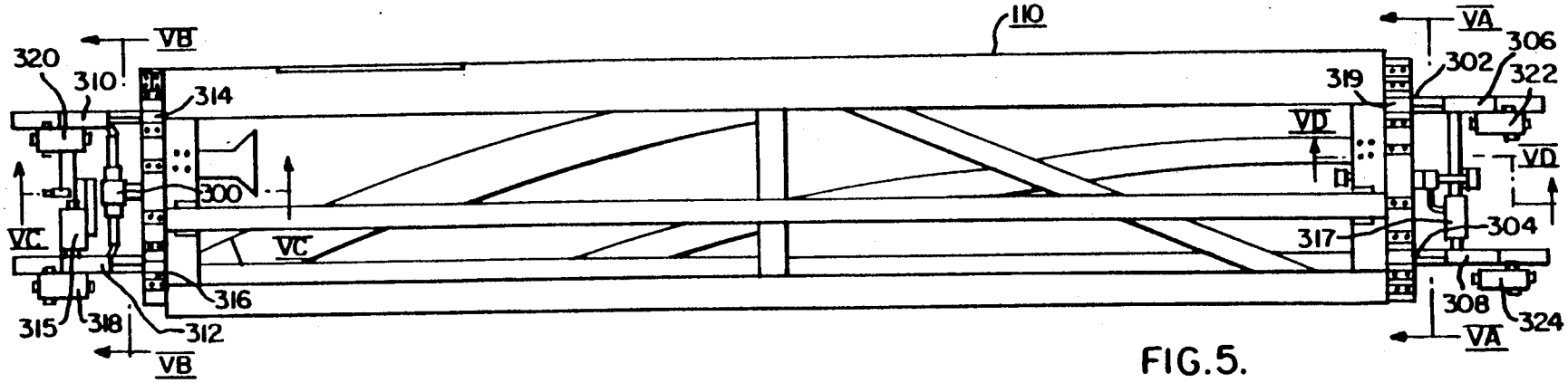
FIG. 5 is a top plan view of the general assembly of the single turnout rotary guideway switch, i.e. the assembly of the movable switch portion with frog and point end equipment frames.

The assembly of the rotary switch frame 110 with the fixed equipment frames 149 and 153 is shown most clearly in FIG. 5. This Figure is similar to FIG. 3 but it is slightly enlarged and it highlights more assembly detail. FIGS. 5A through 5E show views taken along the indicated reference planes and are further enlarged to provide a better showing of various features of the structural assembly.

As shown in FIG. 5, the drive shaft 142 is driven by a rotary hydraulic actuator 300 of the piston driven rack and pinion type. In the referenced commercial embodiment, the rotary actuator had a maximum torque of 30,000 in. lbs. with system relief maintained at a pressure of 1200 psi. Maximum working capacity is 75,000 in. lbs. at 3000 psi.

Point end lock pins 302 and 304 are respectively driven by hydraulic actuators 306 and 308. Similarly, frog end hydraulic actuators 310 and 312 respectively drive point, end lock pins 314 and 316. The actuators have built-in cushions for end-of-stroke deceleration.

Figure 5D:
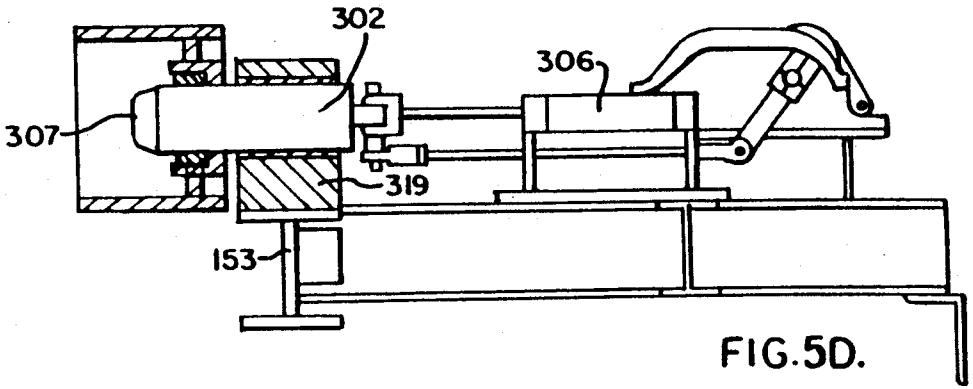
FIGS. 5A through 5D show various enlarged views taken along the indicated reference planes in FIG. 5 to illustrate the rotational support shaft and lockpin operating systems.
Figure 5E:
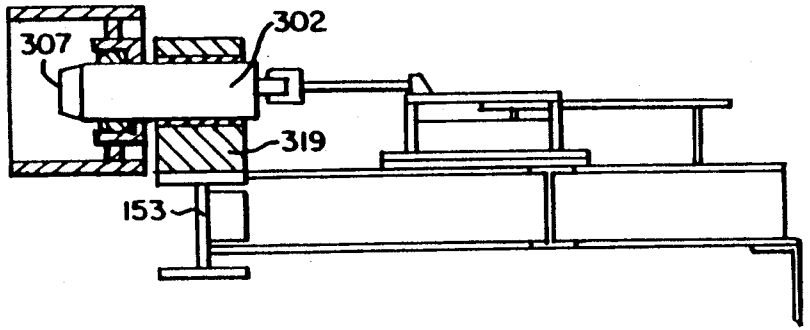
FIG. 5E is a view similar to 5D showing an inactive switch.
Figure 5A:
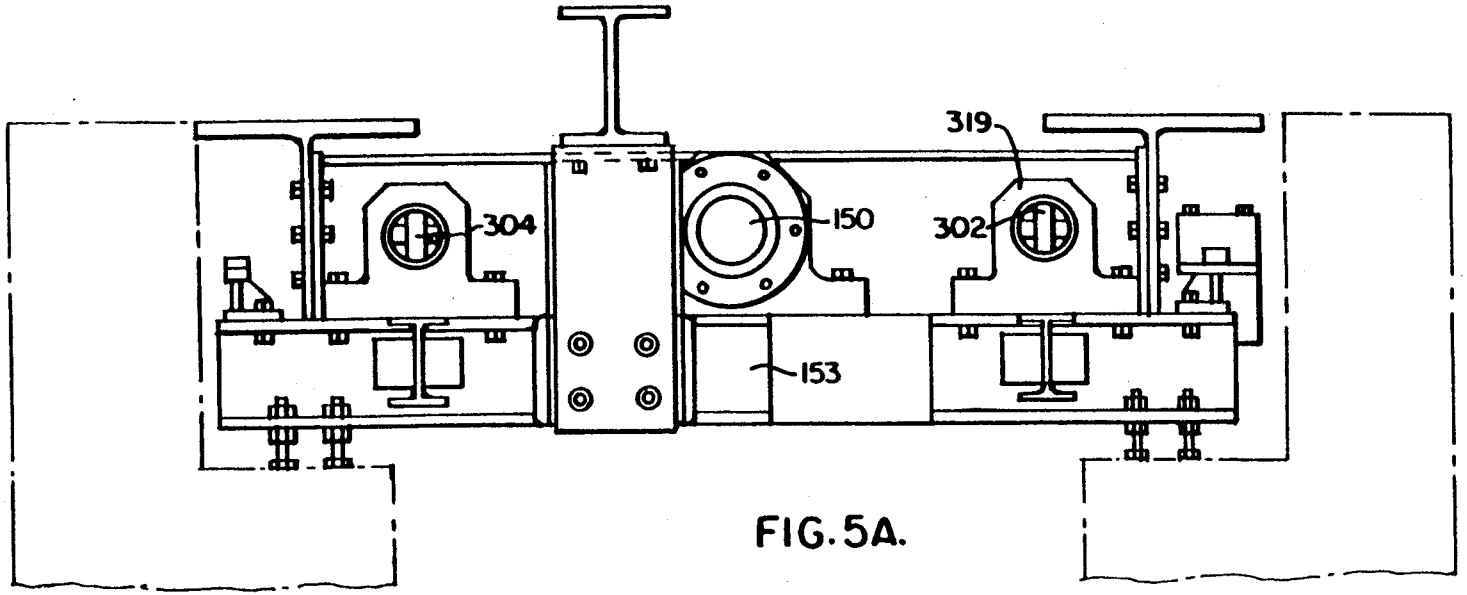

FIG. 5A shows the fixed equipment frame 153 from the point end and toward the rotary switch frame. Accordingly, the spatial relationship of the passive shaft 150 and the lockpins 304 and 302 is clearly illustrated.

Figure 5C:
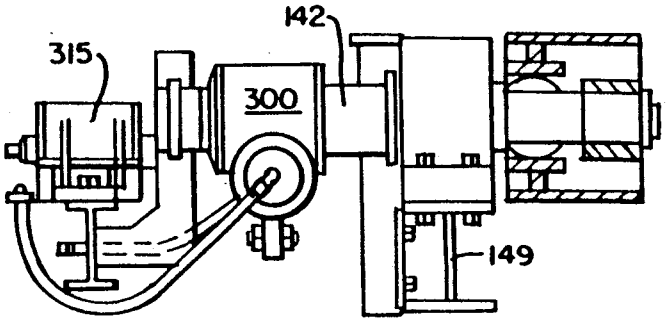
Figure 5B:
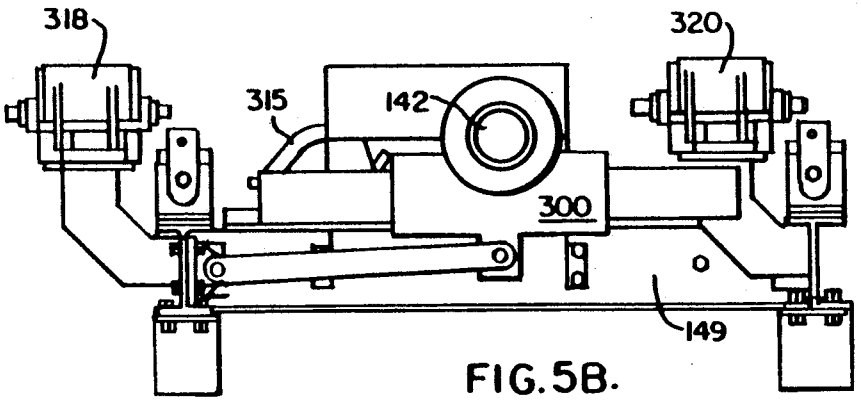
Figure 6A:
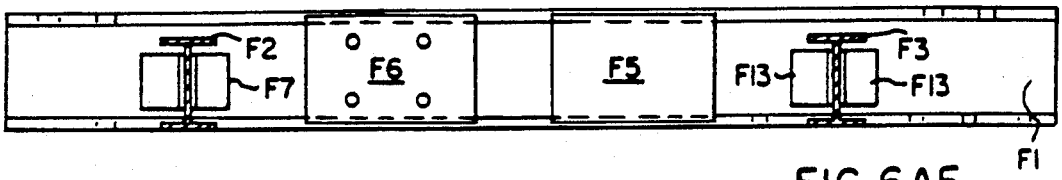
Figure 6B:
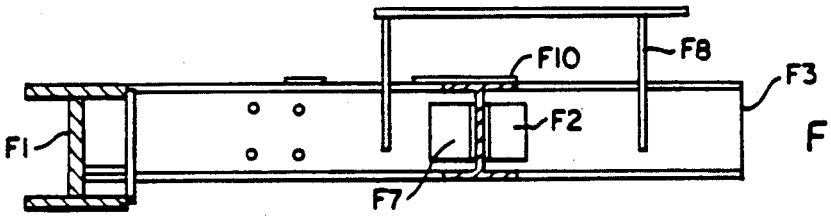
Figure 6C:
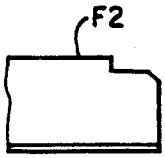
Figure 6D:
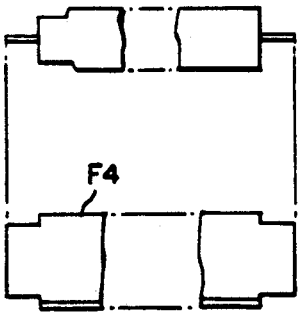
Figure 6E:
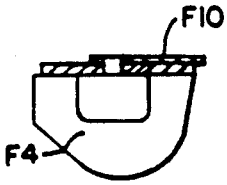
Figures 3F, 6:
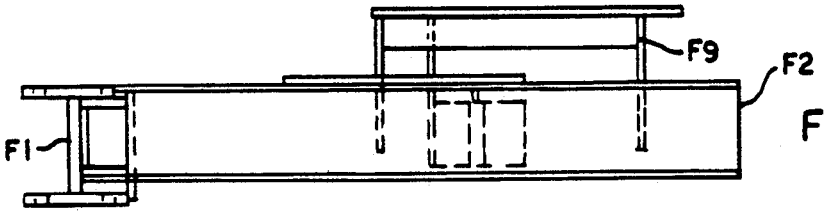
Figures 1P, 6:
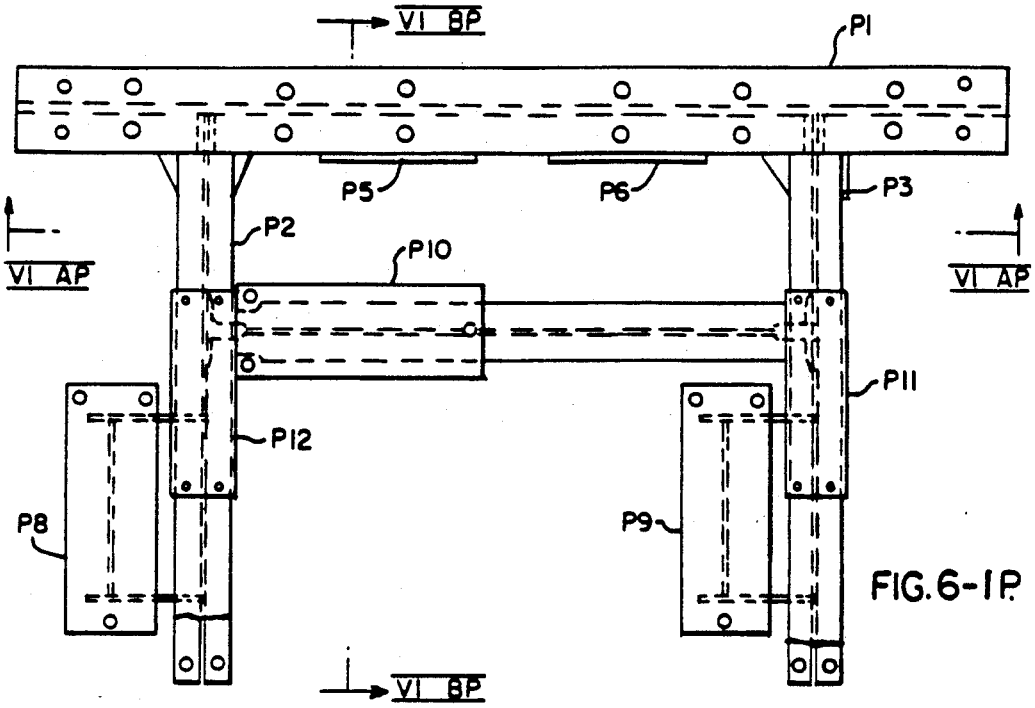
Figures 2P, 6:
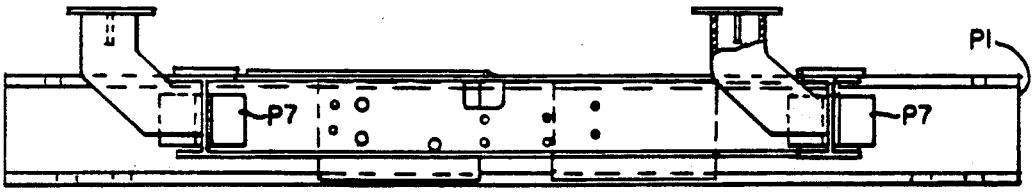
Figures 3P, 6:
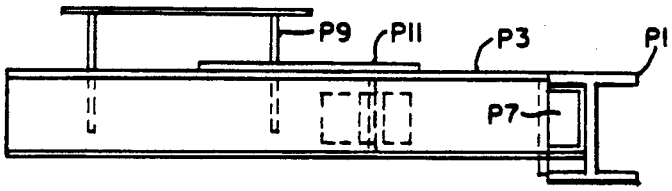
Figure 6A:
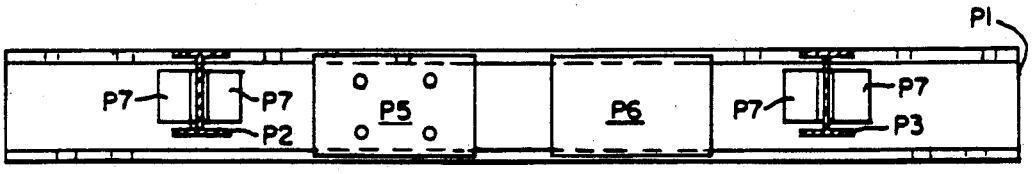
Figure 6F:
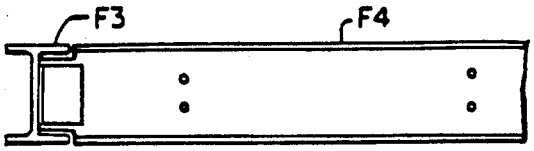
Figures 1F, 6:
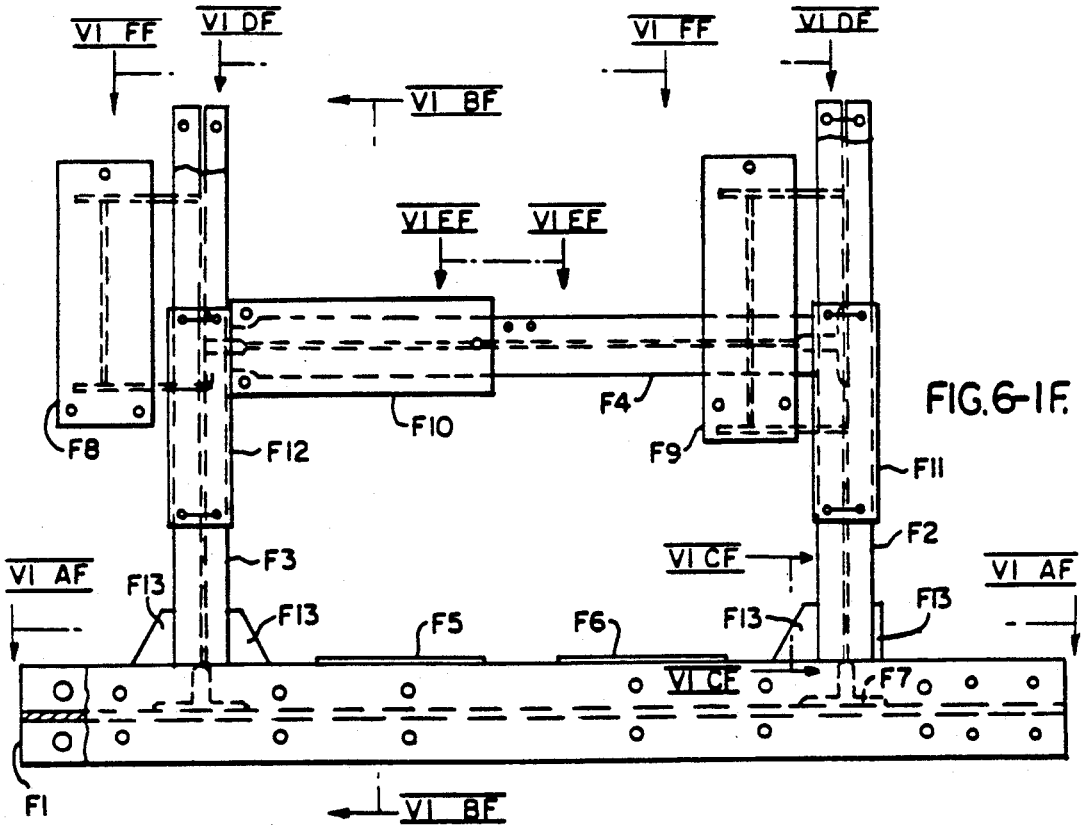
Figure 6B:
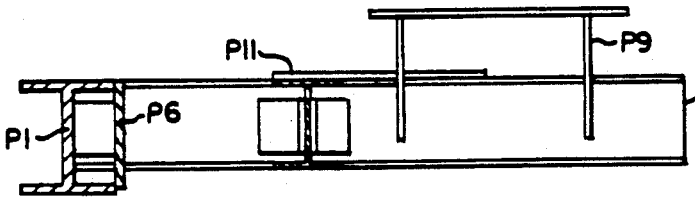
Figures 2F, 6:
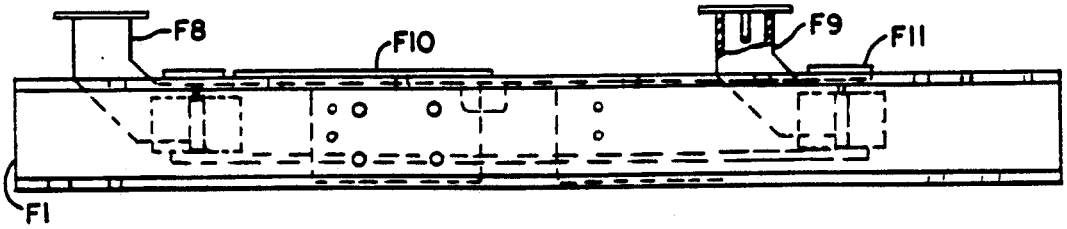

FIG. 5B is an enlarged view that shows the frog end lockpin and rotary shaft actuators in elevation from the frog end of the rotary switch frame. FIG. 5C is an enlarged view showing the relationship of the rotary actuator 300 to the drive shaft 142.

FIG. 5D is an enlarged view that shows the lockpin system with the lockpin 302 in the locked position. When the lockpin is moved to its unlocked position by the actuator 306, pin end face 307 is moved rightward so that it is located within bearing block 319 which is supported by the fixed frame 153. FIG. 5E is similar to FIG. 5D except that it pertains to an inactive switch, i.e. a switch that is installed to provide guideway operation in one lane with the expectation that the switch will be usable at a later date when another lane to which it is to be connected becomes operational. Accordingly, the lockpin is held in a fixed locked position by the structure located to its right in FIG. 5E.

As an additional advantage, the maintenance requirements are relatively minimal because of the simplicity of design and operation of the rotary switch. Thus, the spherical, sleeve and tapered roller bearings supporting the switch shafts and the lockpins can be selected for high capacity with extended life and minimal maintenance. Readily accessible grease fittings are preferably used to facilitate periodic lubrication. The lockpins, shafts, gear segments, and hardware associated with the lockpin actuating cylinders are preferably made from stainless steel to resist the detrimental effects of corrosion. Further, shafts are preferably oversized to assure product durability.

Respective position sensors (referred to in the trade as controllers) 318, 320, 322, and 324 are provided to generate feedback position signals for the lock pins 314, 316, 302 and 304. Gear driven position sensors 315 and 317 are respectively coupled to the frame shafts 142 and 150 to provide feedback signals that define the rotary frame position.

The hydraulic actuator and sensor equipment items are supported on the respective frog end and point end fixed frames 149 and 153. The frog end fixed frame structure is shown in greater detail in FIGS. 6-1F, 6-2F, 6-3F, and 6AF through 6DF. The point end fixed frame structure is shown in greater detail in FIGS. 6-1P, 6-2P, 6-3P, and 6AP through 6FP.

POWER AND SIGNAL RAIL STRUCTURE

Figures 7, 7A, 7B:
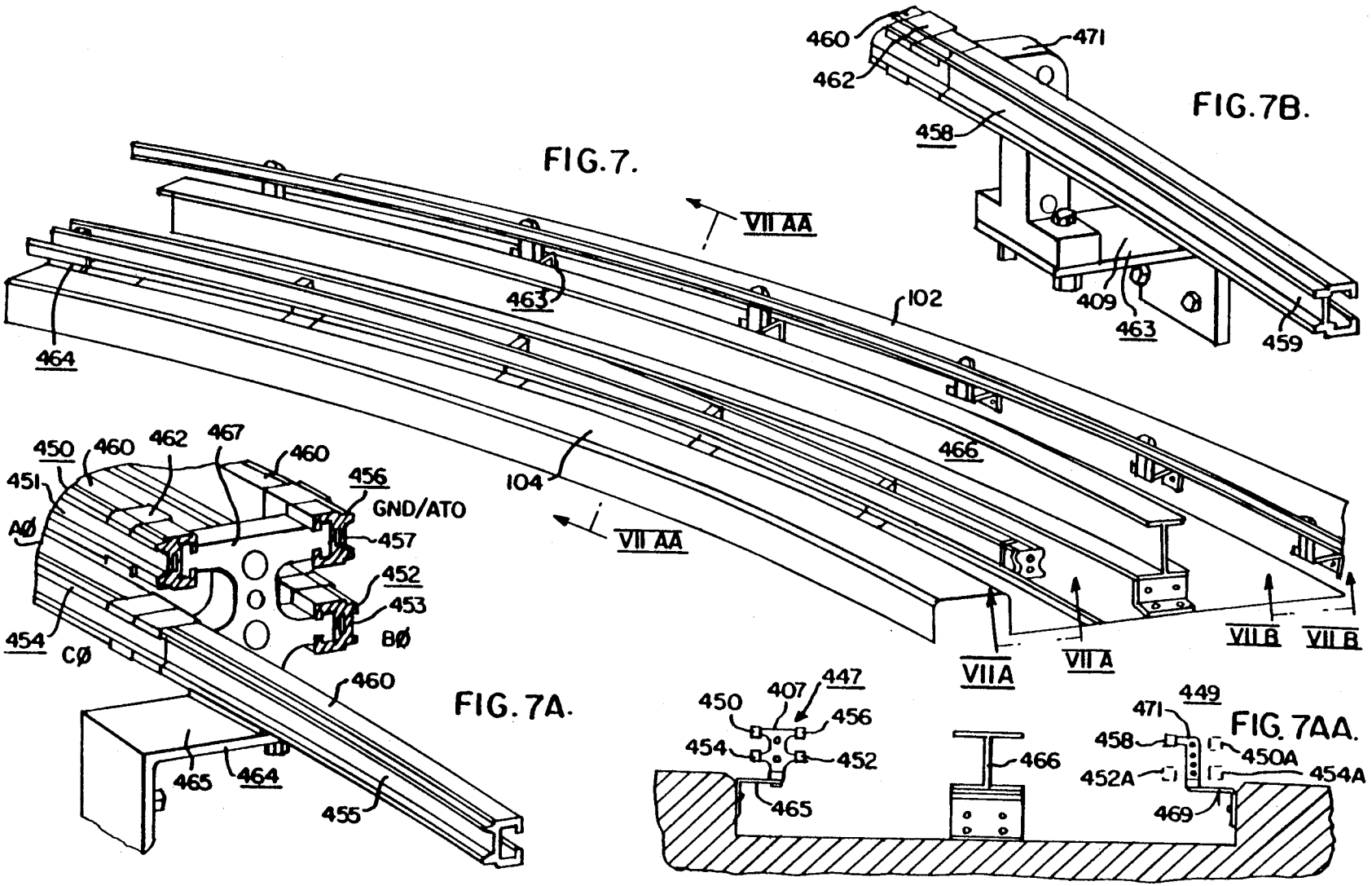
FIG. 7 shows a perspective view of a typical guideway section having the electrical rail structure highlighted.
FIGS. 7A and 7B show enlarged views of the electrical rail structure.

The power and signal rail structure is shown more clearly in the FIG. 7 series of drawings.

A perspective view of a typical guideway section is shown in FIG. 7 with the rail structure highlighted. In this case, a total of five electrical rails are needed and four of the rails are supported as a first rail unit 447 that extends along the guideway structure just inside and just above the left tire path 104. The fifth rail is supported as a second rail unit 449 that extends along the guideway structure just inside and just above the right tire path 102. The guidebeam 466 extends along the guideway midway between and parallel to the electrical rail units.

As previously indicated, the guidebeam and electric rail structure is symmetrically disposed about the guideway lane centerline to enable vehicle turnaround operation. The guidebeam is located along the lane centerline and thus is symmetric with reference to it.

In addition, the two electric rail units are disposed on opposite sides of the lane centerline at equal distances from the lane centerline. Generally, a four-brush collector assembly is provided on each side of the vehicle undercarriage for current collection interface with the symmetrically disposed rail units.

When the vehicle is travelling in one lane direction, one of the collector assemblies provides current collection through its four collector brushes from the four electric rails on the current collector four-rail unit 447, and the other collector assembly provides current collection through one of its four collector brushes from the one electric rail on the one rail unit 449. When the vehicle is turned around to move in the opposite lane direction, the interfacing of the vehicle collector assemblies with the rail units 447 and 449 is reversed.

A three phase, Y-connected alternating current power system is employed to supply drive current to the vehicles on the guideway system. Rails 450, 452, and 454 on the rail unit 447 (FIG. 7A) respectively operate as the A, B and C phase conductors. Alternate locations of the rails 450, 452 and 454 are shown in phantom in FIG. 8AA only as 450A, 452A and 454A to illustrate another symmetric arrangement of the electric rails. Generally, the guideway length is divided into power blocks supplied by respective power sources (i.e. substations), and each power block is supplied by hard wires extending from the power source through the guideway cable troughs to the power block connection point.

Typically, the full length of each power rail is formed by successive, practical length rail sections connected end-to-end. For example, each rail section could be thirty feet in length, and successive power rail sections within a power block are connected by conductive joiners (not shown). Successive rail sections at the boundary line between power blocks are connected by an isolation joiner (not shown).

A two-conductor system is used to supply automatic train operation (ATO) signals to vehicles on the guideway. Rails 456 (on rail unit 447) and 458 (on rail unit 449) operate as the two ATO conductors in each successive signal block along the length of the guideway. The signal blocks are normally different from and independent of the power blocks.

In successive signal blocks, the function of the signal rail 456 is alternated from GND to ATO to GND, etc. Similarly, the function of the signal rail 458 is alternated from ATO to GND to ATO so that the functions of the two signal rails 456 and 458 are reversed from signal block to signal block. Therefore, successive thirty foot signal rail sections within a signal block are interconnected by conductive joiners, but at the boundary between successive signal blocks successive rail sections are interconnected by isolation joiners. The signal ground rail in each signal block is hard wired to ground.

Each power and signal rail is provided with an elongated insulative cover 460, and joints between successive cover lengths are bridged by insulative joint covers 462. Generally, the covers 460 provide insulation coverage for the entire rail conductive surface except for respective longitudinally extending vertical surfaces 451, 453, 455, 457, and 459 which are exposed for contact by vehicle mounted electrical brushes.

Each rail unit 447 or 449 is supported in place by power/signal rail mounts 464 or signal rail mounts 463 which are suitably spaced along the length of the guideway. Each mount 464 is formed by an angle bracket 465 secured to the guideway structure (FIG. 7AA) and an insulative rail holder 467 having a support arm for each rail. Each mount 463 has an angle bracket 469 secured to the guideway structure and an insulative signal rail holder 471.

Figure 7C:
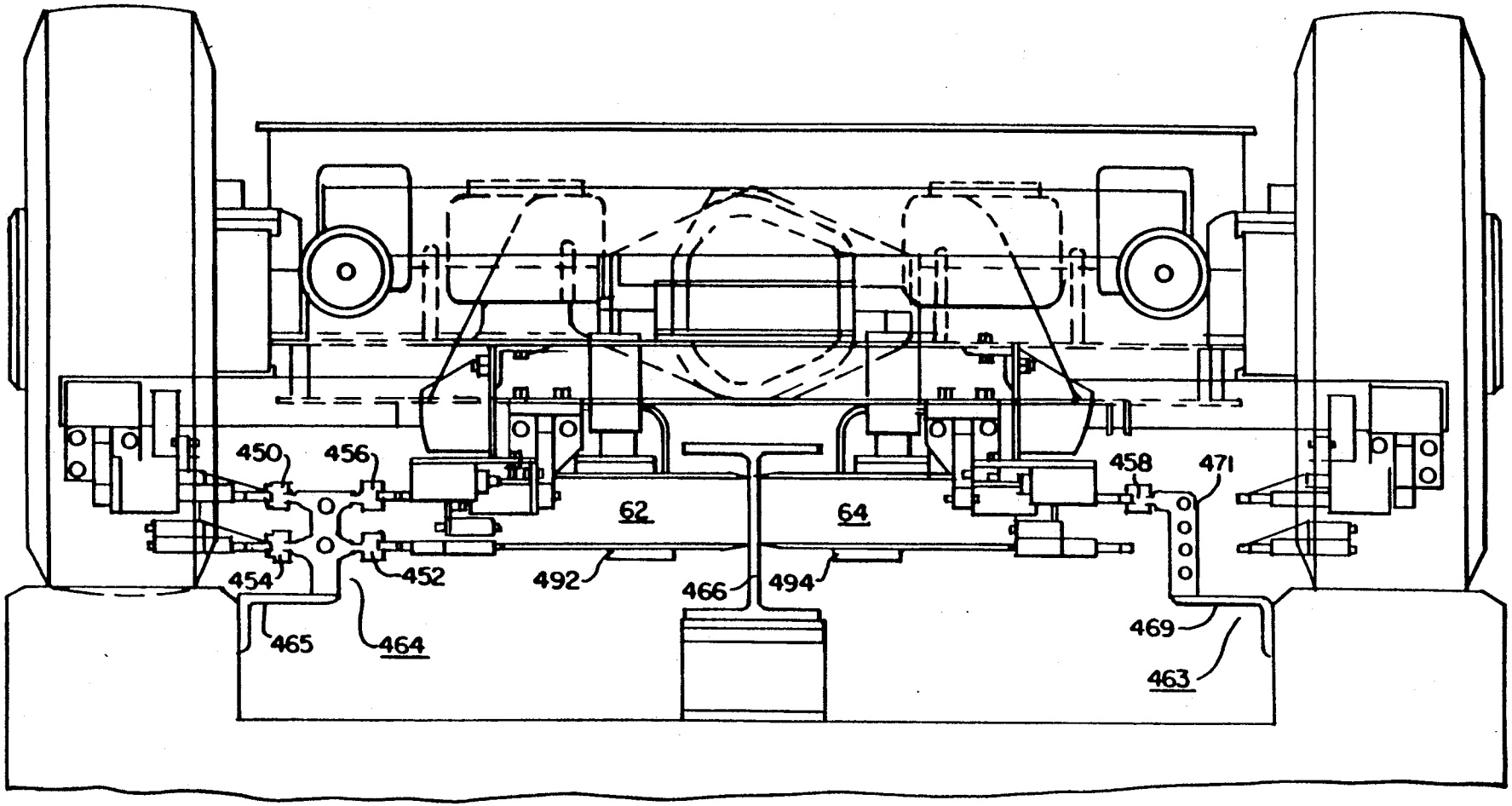
FIG. 7C shows the bogey assembly of a vehicle and its guideway interface.

An enlarged bogey assembly view is shown in FIG. 7C to illustrate more clearly the power and signal connections between the electrical rails and the vehicle brushes. With respect to turnaround operation of a vehicle one, of the vehicle collector assemblies interfaces with the rail unit 447 and has three of its brushes collecting power from the three power rails 450, 452 and 454 and its fourth brush providing signal collection from the signal or ground rail 456 when the vehicle is travelling in one lane direction. In the opposite lane direction the same collector assembly has its three power collector brushes floating (inactive) and its fourth brush providing signal collection from the signal or ground rail 458 on the other rail unit 449. The other collector assembly operates in the same way but in reverse.

An electrical interface is provided for the guideway electrical rails and the short electrical rail sections on the rotary guideway switch and the short electrical rail sections on any interface guideway structure that may be needed for switch installation (as in the case of a crossover switch installation described subsequently herein). Preferably, hard wire connections are made between the respective power and signal rails on the fixed guideway structure to the corresponding power and signal rail sections on the rotary switch. In addition, a hard ground wire is extended from a ground connection to the rotary switch for frame grounding.

Figure 7D:
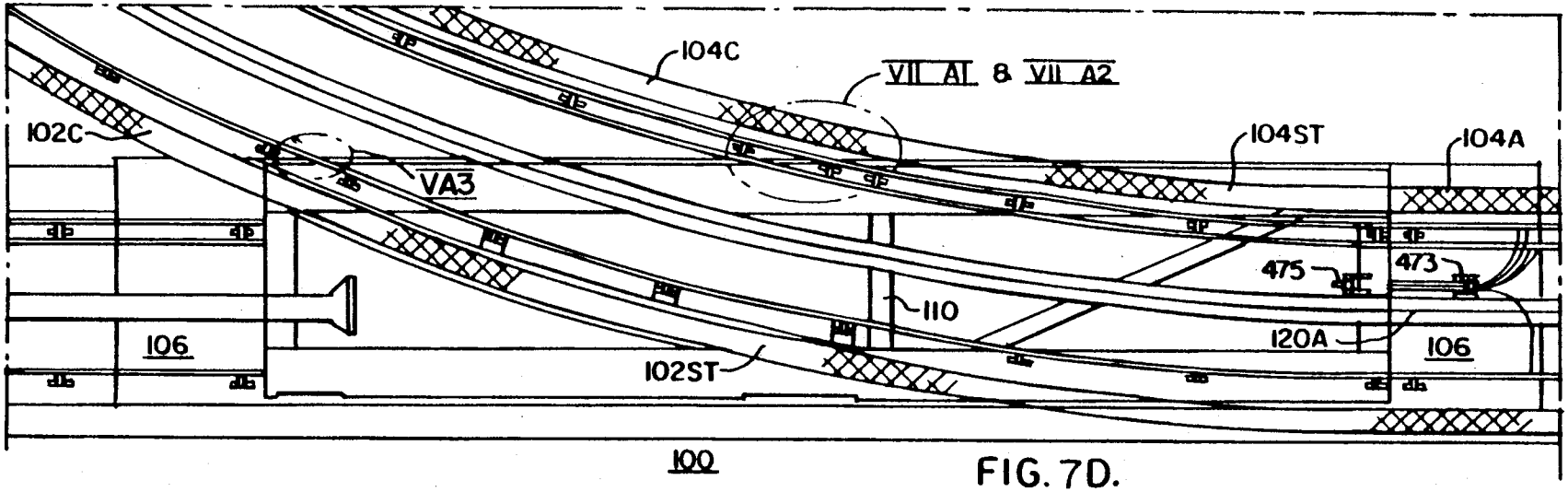
FIGS. 7D and 7E show top plan views of the assembled single turnout rotary guideway switch with a highlighting of cabling used to make electrical connections to the switch.
Figure 7E:
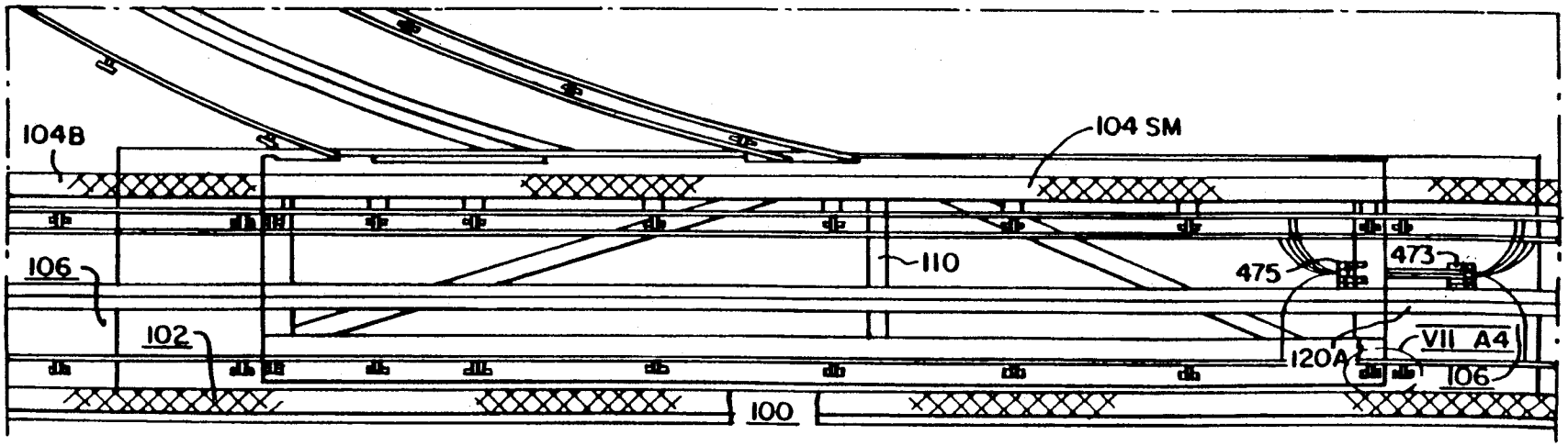

In FIG. 7D, there is shown a top plan view of the single turnout rotary guideway switch in its turnout position and with the power and signal rail structure highlighted. FIGS. 7A1, 7A2, 7A3 and 7A4 show enlarged views of the electrical rail interfaces between the fixed and movable switch electrical rail structure in the turnout lane. FIG. 7E is like FIG. 7D but it shows the switch in its tangent or main lane position. FIG. 7EC shows an enlarged typical view of the electronic interfaces between fixed and movable electric rail structure in the main lane position.

To establish electrical continuity for the guideway switch in accordance with the present invention, a total of six interconnection conductors couple the fixed guideway, conductors to the rotatable switch conductors as follows: 3 power conductors, 4 shielded signal conductor pairs and a ground conductor. In addition, a separate pair of power conductors are included in the cable for connection to power and signal rails to provide rail heating. The 10 conductors are bundled together at the point end of the switch pit 112 as indicated by the reference character 473, and the bundle is extended through a suitably sized bore (such as 2.25 inches diameter) in the point end shaft 150 as indicated by the reference character 475. On the switch frame side of the point end shaft, the conductors are divided out of the bundle (see FIG. 7E) and extended to the points where rail or frame connections are to be made.

The inwardly facing bore surface is polished and the conductor bundle 473 is preferably encased in a nylon wrapping (not indicated) and secured by end of shaft cable clamps so that the bundle 473 is free to flex substantially without abrasion. As the switch is rotated between its main lane and turnout positions, it moves through 180 degrees and the cable bundle 473 flexes through a corresponding twisting movement, i.e. preferably ±90 degrees over a five foot length. In tests, this interconnection scheme was found to be entirely satisfactory, i.e. no significant wear was produced on the bundle sheath after 40,000 switching operations.

In applying the present invention, the design of commercial rotary guideway switches can incorporate relatively small gaps between each switch tire path and each longitudinally adjacent fixed guideway tire path. The gap size, for example, can be ¼ inch which permits in excess of ±⅛ inch thermal expansion. Such small gap structure provides a foundation for two important benefits: 1) continuity in high speed power collection and 2) smoothness of vehicle ride.

OVERVIEW - SWITCH OPERATION

In the operation of the people mover system, each rotary guideway switch position is specified over the ATO circuit according to the path to be followed by vehicles moving in the system. Switch positions, sensed as previously noted, are checked against specified positions and any required changes are sent as switching commands over the ATO system. Wayside interlocking logic detects any guideway switch that fails to be positioned and locked as commanded and initiates safety car stoppage until the problem is corrected. If necessary, manual switch operation can be executed by operation of the hydraulic unit at the guideway switch location.

At the guideway switch location, a switch position change is implemented by the following actions:

1. The lock pin hydraulic actuators withdraw the switch frame lock pins.
2. The lock pin position sensors verify the withdrawal of the lock pins.
3. The rotary hydraulic actuator turns the drive shaft until the switch frame has moved from its previous position to its new position.
4. The shaft position sensors verify the existence of the new switch frame position.
5. The lock pin hydraulic actuators insert the lock pins into the switch frame.
6. The lock pin position sensors verify the insertion of the lock pins.

Total time for executing a switching operation is typically 10 seconds.

When the rotary guideway switch is in the main lane position, vehicle loading forces the switch frame toward the stop structure in the main lane position. Safe operation thus occurs even if the lock pins have been withdrawn from the switch frame and not reinserted for some reason.

Switch manufacture is significantly economized and switch operation is significantly facilitated by the fact, that the switch structural strength and weight can be safely and relatively reduced because:

1. Reduced vehicle loading results from structuring the rotary switch so that only those tires on one side of the vehicle, or the substantial equivalent thereof, can be on the guideway switch as the vehicle moves over the switch in either switch position.
2. Reduced frame, lock pin and shaft strength requirements result from the hinge line, simple support arrangement.

As previously indicated, significant savings in system construction costs and enhancement in system aesthetics are provided by avoidance of any requirement for guideway bulging at crossover switching locations. These advantages essentially result from the "single" tire path configuration of the rotary switch.

From the standpoint of product strength, vertical loads induced in the switch frame are transmitted through the lock pins to the lock pin guide blocks on the equipment frames to the support pillasters. In the referenced commercial embodiment, the weight of the switch frame itself is 16,500 lbs.

Vehicle load is induced on the switch frame through the vehicle tires. In the commercial embodiment, load was specified at 7500 lbs. per tire with an axle spacing of 14.5 feet and with at most three; tires on the rotary switch frame. Maximum lateral loads due to guide tires was 3000 lbs. resulting in 3000 lbs. lateral load and an additional 1000 lbs. vertical load per main axle. To accommodate vehicle braking and acceleration on the switch frame, each equipment support was sized to take in excess of 9600 lbs. longitudinal load. Overall, switch frame stiffness was employed to limit deflection to less than ¼ inch in the tangent switch position and less than ⅛ inch in the turnout position at specified vehicle loading. Differential thermal expansions of concrete, steel, aluminum and rigid plastic also were reflected in the commercial rotary, switch design.

From the standpoint of safety, the following summary comments apply:

1. The switch tends by its own weight to rotate into the closest alignment position against structural stops.
2. In the high speed tangent position, the vehicle tires are only on one side of the switch frame to hold the switch against the stops even if the lock pins are unlocked.
3. The lock pins are sized to be structurally redundant, i.e. four levels of switch support in addition to the support from the structural stops.
4. Vehicle wrong entry stops keep the vehicle locked onto the guideway.
5. Continuous power and signal rail through the switch eliminates vehicle speed restrictions often required with the use of guideway switches having mechanical on/off rail ramping.

What is claimed is:

1. A rotary switch for a people mover guideway having a predetermined tire path, guidebeam and electric rail configuration, the electric rail configuration including a power rail circuit and a signal rail circuit, said rotary switch providing for routing a transit car having electric power and signal collection means from one entry guideway path to at least either of two exit guideway paths or vice versa and comprising:

an elongated structural switch frame member provided with guidebeam, electric rail and tire path structure on one side compatible with the guideway configuration to provide car routing to one of said two exit paths; said switch frame member further provided with guidebeams, electric rail and tire path structure on another side compatible with the guideway configuration to provide car routing to the other of said two exit paths;

first support means having first shaft means for supporting one end of said switch frame member;

second support means having second shaft means for supporting the other end of said switch frame member;

means for driving at least one of said shaft means to rotate said switch frame between first and second frame positions;

said switch frame member having its one side aligned with the entry guideway path and the one exit guideway path in said first frame position and having its other side aligned with the entry guideway path and the other exit guideway path in said second frame position;

said first support means including first fixed frame means for supporting said first shaft means;

said second support means including second fixed frame means for supporting said second shaft means;

means for locking said switch frame member against rotation from said first or second frame position;

said electric rail structure on each side of said switch frame member including power rail means and signal rail means disposed along respective paths of travel of a transit car over said switch for respectively contacting the electric collection means of the transit car;

electric connection means including: first electric conductor means for connecting said switch power rail means to the guideway electric power rail circuit; and second electric conductor means for connecting said switch signal rail means to the guideway signal rail circuit; and means for supporting at least said first and second electric conductor means to permit rotational motion of said switch frame member between its two frame positions while maintaining electric continuity from the guideway electric power and signal circuits, respectively, to said electric power and signal rail means on the two sides of said switch frame member.

2. A rotary guideway switch as set forth in claim 1, wherein one of said shaft means has a bore therethrough, said first and second conductor means extend through said bore and are supported by said one shaft means.

3. A rotary guideway switch as set forth in claim 1, wherein said electric connection means includes insulative cover means, said first and second electric conductor means are bundled together in said insulative cover means to form an electric cable supported by said conductor supporting means.

4. A rotary guideway switch as set forth in claim 3, wherein one of said shaft means has a bore therethrough, said cable extends through said bore and is supported by said one shaft means, said first and second electric conductor means extend in unbundled relation from said cable on the switch side of said cable to respective electrical connection points on said guideway switch, and said first and second conductor means extend in unbundled relation from said cable on the guideway side of said cable to respective connection points on said predetermined guideway.

5. A rotary guideway switch as set forth in claim 4, wherein said cover means comprises nylon and said bore has an inwardly facing surface that is polished to minimize abrasion of said cable.

6. A rotary guideway switch as set forth in claim 4, wherein said cable is a predetermined minimum length to provide longitudinally distributed cable flexing with guideway switch rotation that leads to acceptably long cable life.

7. A rotary guideway switch as set forth in claim 6, wherein said cable is approximately five feet long and said switch rotates back and forth between its frame positions through approximately 180 degrees.

8. A rotary guideway switch as set forth in claim 3, wherein said first electric conductor means includes three power conductors for connection to said power rail means and said second electric conductor means includes two shielded conductor pairs and a ground conductor.

9. A rotary switch as set forth in claim 8, wherein said electric connection means includes third electric conductor means in said cable, said third electric conductor means including a pair of power conductors connected to said switch power and signal rail means to provide rail heating.

10. A rotary switch as set forth in claim 3, wherein said first support means includes first means for supporting said switch frame member in fixed relationship to said first shaft means at one end of said switch frame member, and said second support means includes means for supporting said switch frame member in longitudinally expandable relation to said second shaft means at the other end of said switch frame member.

11. A rotary guideway switch as set forth in claim 3, wherein said first and said second support means and said locking means further support said frame for pivotal deflection about respective transverse hinge lines at the ends of said switch frame member.

* * * * *